US010481536B2

(12) United States Patent
Fujita et al.

(10) Patent No.: US 10,481,536 B2
(45) Date of Patent: Nov. 19, 2019

(54) MOUNTED FIXING APPARATUS FOR FIXING AN IMAGE FORMED ON A RECORDING MEDIUM

(71) Applicant: CANON KABUSHIKI KAISHA, Tokyo (JP)

(72) Inventors: Keisuke Fujita, Sagamihara (JP); Naoki Hayashi, Yokohama (JP); Masaaki Takeuchi, Tokyo (JP); Koji Fujinaka, Chofu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/260,673

(22) Filed: Jan. 29, 2019

(65) Prior Publication Data

US 2019/0171144 A1 Jun. 6, 2019

Related U.S. Application Data

(62) Division of application No. 15/551,772, filed as application No. PCT/JP2016/000453 on Jan. 28, 2016, now Pat. No. 10,248,058.

(30) Foreign Application Priority Data

Feb. 19, 2015 (JP) ..... 2015-031048
Feb. 19, 2015 (JP) ..... 2015-031049
Feb. 19, 2015 (JP) ..... 2015-031050

(51) Int. Cl.
*G03G 15/20* (2006.01)
*G03G 15/00* (2006.01)

(52) U.S. Cl.
CPC ..... *G03G 15/2053* (2013.01); *G03G 15/2039* (2013.01); *G03G 15/55* (2013.01); *G03G 2215/2035* (2013.01)

(58) Field of Classification Search
CPC ..... G03G 15/2053; G03G 15/2039; G03G 15/55; G03G 2215/2035
See application file for complete search history.

(56) References Cited

U.S. PATENT DOCUMENTS 5,493,379 A * 2/1996 Kuroda ..... H05B 1/0241 219/216
5,828,035 A * 10/1998 Kuroda ..... G03G 15/2064 219/216

(Continued)

FOREIGN PATENT DOCUMENTS

CN 1129042 C 11/2003
CN 103917923 A 7/2014

(Continued)

*Primary Examiner* — Sophia S Chen
(74) *Attorney, Agent, or Firm* — Canon U.S.A., Inc. IP Division

(57) ABSTRACT

The present invention relates to a fixing apparatus including a tubular film, a heater provided at an inside of the film, a protection element provided at the inside of the film, and at least one conductive member provided at the inside of the film. The protection element includes two terminals and a switch that turns off to shut off power to the heater when the heater abnormally generates heat. A first end of the conductive member is electrically connected to one of the terminals of the protection element. The conductive member is not coated with an insulator, and a second end of the conductive member projects out of the film so that the cost of the fixing apparatus is reduced.

16 Claims, 19 Drawing Sheets

(56) References Cited

U.S. PATENT DOCUMENTS

| | | | | | |
|---|---|---|---|---|---|
| 6,090,305 | A * | 7/2000 | Balch | G06G 15/2053 | 219/216 |
| 6,455,811 | B2 * | 9/2002 | Otsuka | G03G 15/2053 | 118/60 |
| 7,235,761 | B1 * | 6/2007 | Maul | G03G 15/2064 | 219/216 |
| 2004/0166740 | A1 * | 8/2004 | Jorgensen | H01R 13/187 | 439/660 |
| 2015/0277309 | A1 * | 10/2015 | Kuroda | G03G 15/2053 | 219/541 |

FOREIGN PATENT DOCUMENTS

| | | | | |
|---|---|---|---|---|
| JP | H03-182090 | A | | 8/1991 |
| JP | H05-010801 | A | | 1/1993 |
| JP | H06-176852 | A | | 6/1994 |
| JP | H06-202510 | A | | 7/1994 |
| JP | 07219368 | A | * | 8/1995 |
| JP | H09-063658 | A | | 3/1997 |
| JP | 2000-284622 | A | | 10/2000 |
| JP | 2002-156290 | A | | 5/2002 |
| JP | 2006-322996 | A | | 11/2006 |
| JP | 2007-121902 | A | | 5/2007 |
| JP | 2011-118246 | A | | 6/2011 |
| JP | 2014-074770 | A | | 4/2014 |

* cited by examiner

FRONT VIEW

REAR VIEW

REAR VIEW

FRONT VIEW

REAR VIEW

MOUNTED FIXING APPARATUS FOR FIXING AN IMAGE FORMED ON A RECORDING MEDIUM

CROSS REFERENCE TO RELATED APPLICATIONS

The present application is a Divisional of U.S. patent application Ser. No. 15/551,772, filed on Aug. 17, 2017, which is a 371 of International PCT/JP2016/000453, filed Jan. 28, 2016, which claims priority from Japanese Patent Application No. 2015-031048, filed Feb. 19, 2015, Japanese Patent Application No. 2015-031049, filed Feb. 19, 2015, and Japanese Patent Application No. 2015-031050, filed Feb. 19, 2015, which are all hereby incorporated by reference herein in their entirety.

TECHNICAL FIELD

The present invention relates to a fixing apparatus mounted in an image forming apparatus, such as a copier and a printer, for fixing an unfixed image formed on a recording medium to the recording medium.

BACKGROUND ART

A known example of a fixing apparatus mounted in electrophotographic copiers and printers is a fixing apparatus using a film heating system. The film heating fixing apparatus includes a tubular film, a heater in contact with the inner surface of the film, and a pressure roller that forms a nip with the heater, with the film therebetween. The heater is held by a heater holder made of resin. The heater holder is reinforced by a metal reinforcement.

The heater holder has a through-hole in part in the longitudinal direction, through which a temperature detecting element disposed in a space between the heater holder and the reinforcement senses the temperature of the heater. The heater is controlled according to the temperature sensed by the temperature detecting element. The space between the heater holder and the reinforcement further accommodates a protection element, such as a thermal switch and a thermal fuse. The protection element also senses the heat of the heater through another through-hole in the heater holder. The protection element has a function of interrupting power to the heater when the heater overheats (PTL 1).

CITATION LIST

Patent Literature

[PTL 1]
Japanese Patent Laid-Open No. 2011-118246

SUMMARY OF INVENTION

Technical Problem

For signal wires connected to the terminals of the temperature detecting element and power supply wires connected to the terminals of the protection element, electrical cables coated with an insulator are used, as disclosed in PTL 1. These electrical cables need not only insulating properties but also heat-resisting properties because they are disposed inside the film. Furthermore, the electrical cables require better insulating properties and heat-resisting properties as the target control temperature of the heater increases with an increasing printing speed.

However, electrical cables that meet these requirements cost too much. Furthermore, increasing the thickness of the insulating layer to satisfy the insulating properties and heat-resisting properties will increase the space occupied by the electrical cables in the film, hindering achieving size reduction of the fixing apparatus.

The present invention provides a compact, low-cost fixing apparatus.

A fixing apparatus according to a first aspect of the present invention includes a tubular film, a heater provided at an inside of the film, a protection element provided at the inside of the film, and at least one conductive member provided at the inside of the film. The protection element includes two terminals and a switch that turns off to shut off power to the heater when the heater abnormally generates heat. A first end of the conductive member is electrically connected to one of the terminals of the protection element. An unfixed image formed on a recording medium is fixed on the recording medium by the heat of the heater via the film. The conductive member is not coated with an insulator. A second end of the conductive member projects out of the film.

A fixing apparatus according to another aspect of the present invention includes a tubular film, a heater provided at an inside of the film, a protection element provided at the inside of the film, and at least one conductive member provided at the inside of the film. The protection element includes two terminals and a switch that turns off to shut off power to the heater when the heater abnormally generates heat. A first end of the conductive member is electrically connected to one of the terminals of the protection element. An unfixed image formed on a recording medium is fixed on the recording medium by the heat of the heater via the film. The conductive member is a sheet metal. A second end of the conductive member projects out of the film.

A fixing apparatus according to a still another aspect of the present invention includes a tubular film, a heater provided at an inside of the film, a temperature detecting unit provided at the inside of the film, and at least one conductive member provided at the inside of the film. The temperature detecting unit includes two terminals and is configured to detect a temperature of the heater. A first end of the conductive member is electrically connected to one of the terminals of the temperature detecting unit. An unfixed image formed on a recording medium is fixed on the recording medium by the heat of the heater via the film. The conductive member is not coated with an insulator. A second end of the conductive member projects out of the film.

A fixing apparatus according to still another aspect of the present invention includes a tubular film, a heater including an electrode and provided at an inside of the film, a holder provided at the inside of the film, and a power feeding connecter configured to feed power to the heater. The holder is configured to hold the heater. An unfixed image formed on a recording medium is fixed on the recording medium by the heat of the heater via the film. The power feeding connecter includes a contact-side connector and a backup-side connector. The contact-side connector includes a spring contact in contact with the electrode of the heater. The backup-side connector is disposed on a side of a surface of the holder that holds the heater opposite to a side of a surface on which the contact-side connector is disposed. The contact-side connector and the backup-side connector are joined together to form the power feeding connecter. The power feeding connecter is disposed at only one end of the heater in a longitudinal direction of the heater.

Further features of the present invention will become apparent from the following description of exemplary embodiments with reference to the attached drawings.

DESCRIPTION OF EMBODIMENTS

[First Embodiment]

Figure 1A:
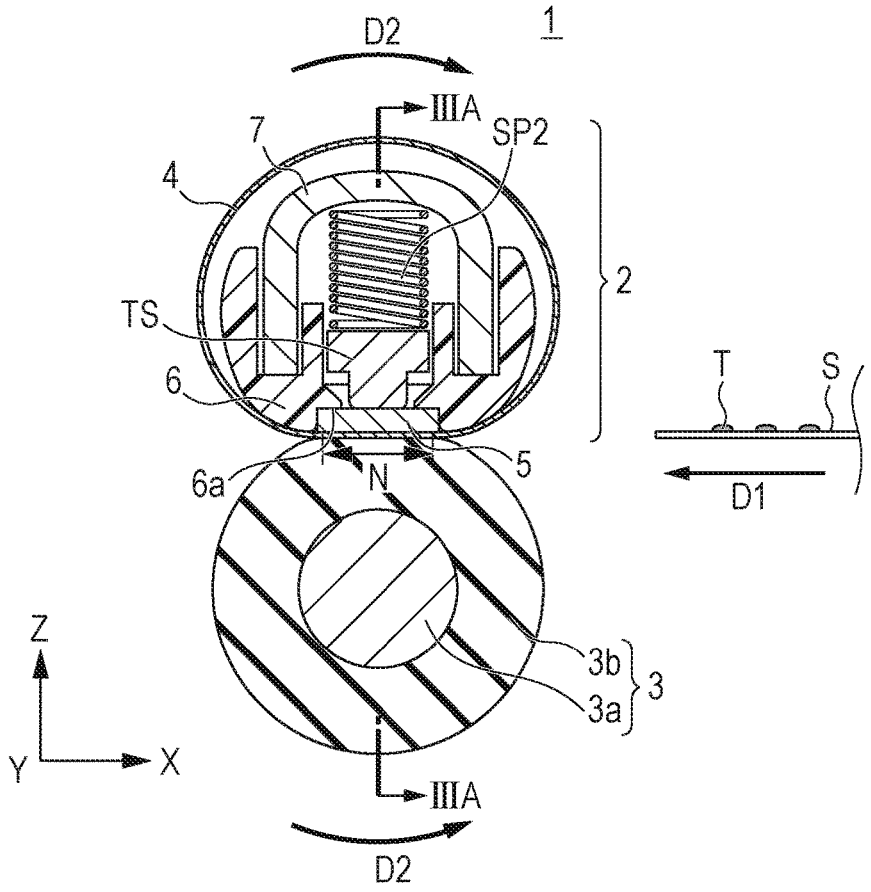
FIG. 1A is a cross-sectional view of a fixing apparatus according to a first embodiment of the present invention.
Figure 1B:
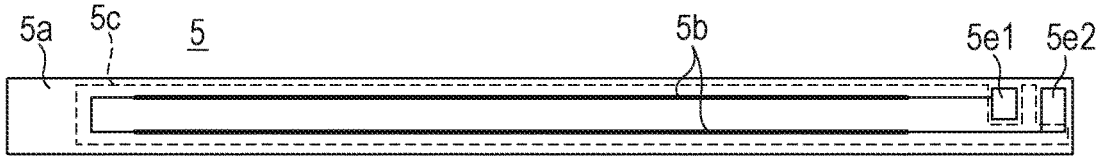
FIG. 1B is a configuration diagram of a heater according to the first embodiment.
Figure 2A:
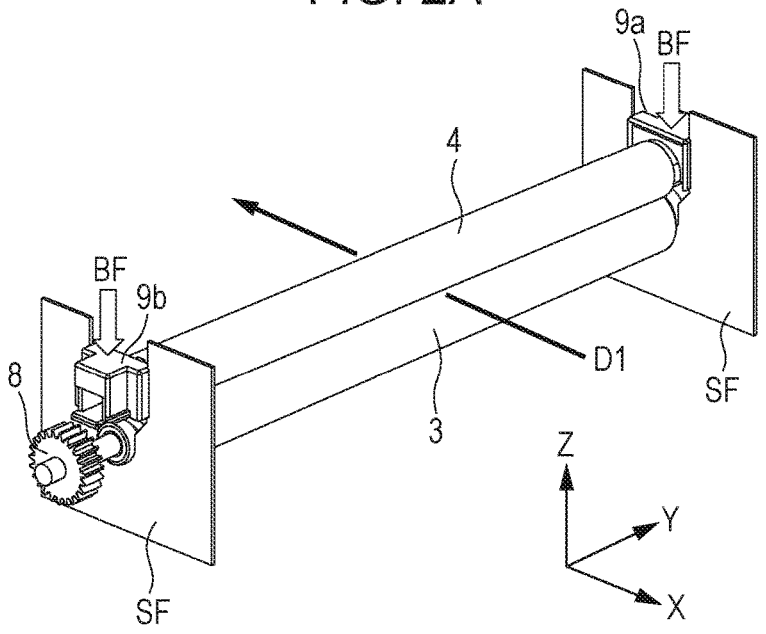
FIG. 2A is a perspective view of the fixing apparatus.
Figure 2B:
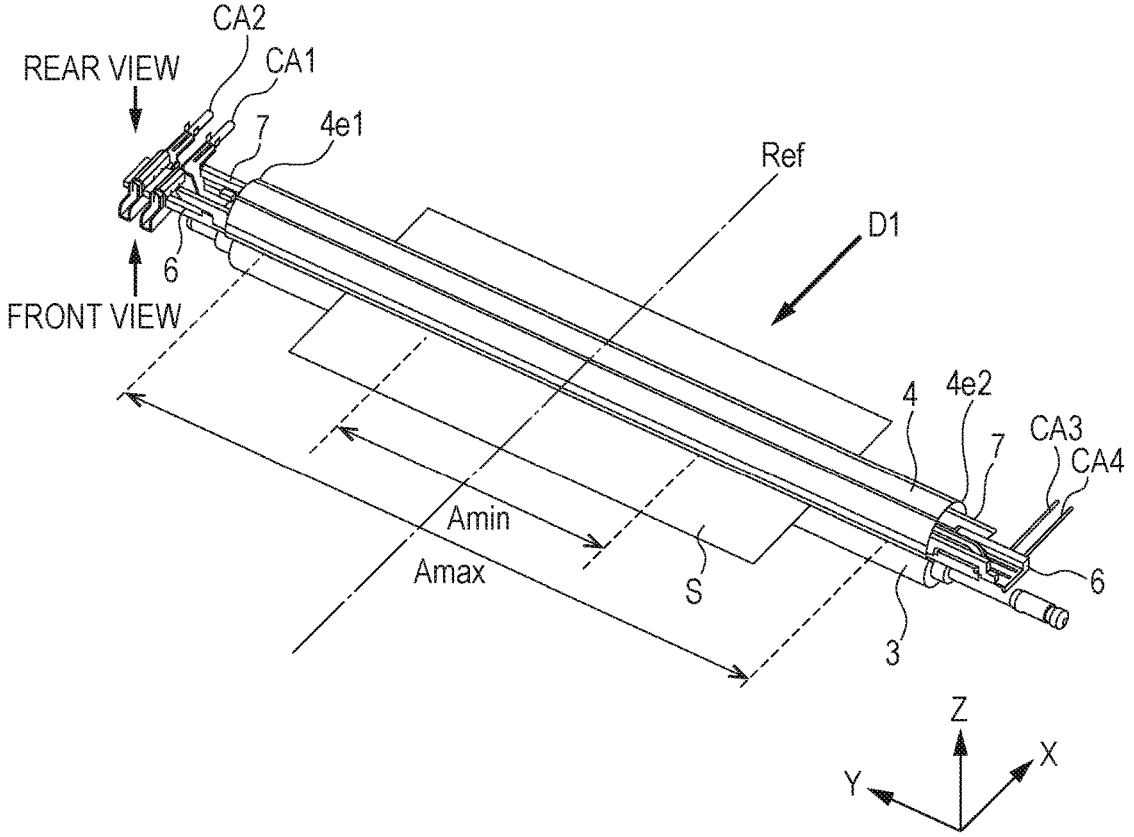
FIG. 2B is a perspective view of the fixing apparatus.
Figure 3A:
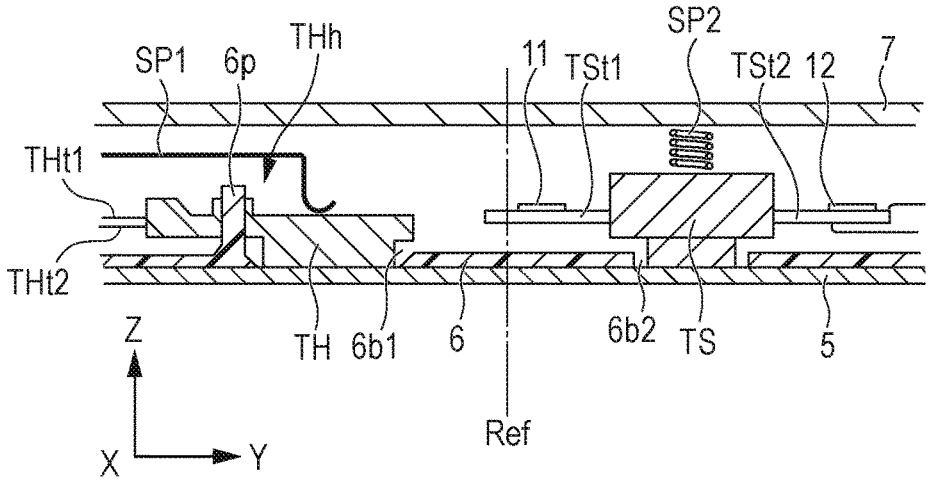
FIG. 3A is a cross-sectional view of a film unit taken along line IIIA-IIIA in FIG. 1A.
Figure 3B:
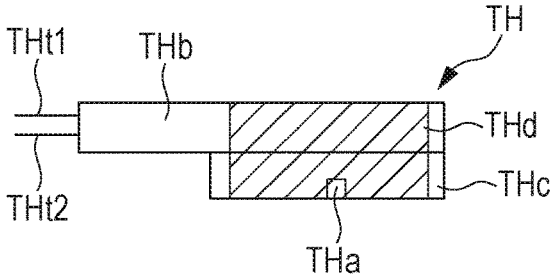
FIG. 3B is a configuration diagram of a thermistor unit according to the first embodiment.
Figure 3C:
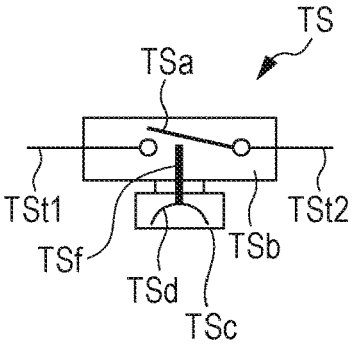
FIG. 3C is a configuration diagram of a thermal switch according to the first embodiment.
Figure 4:
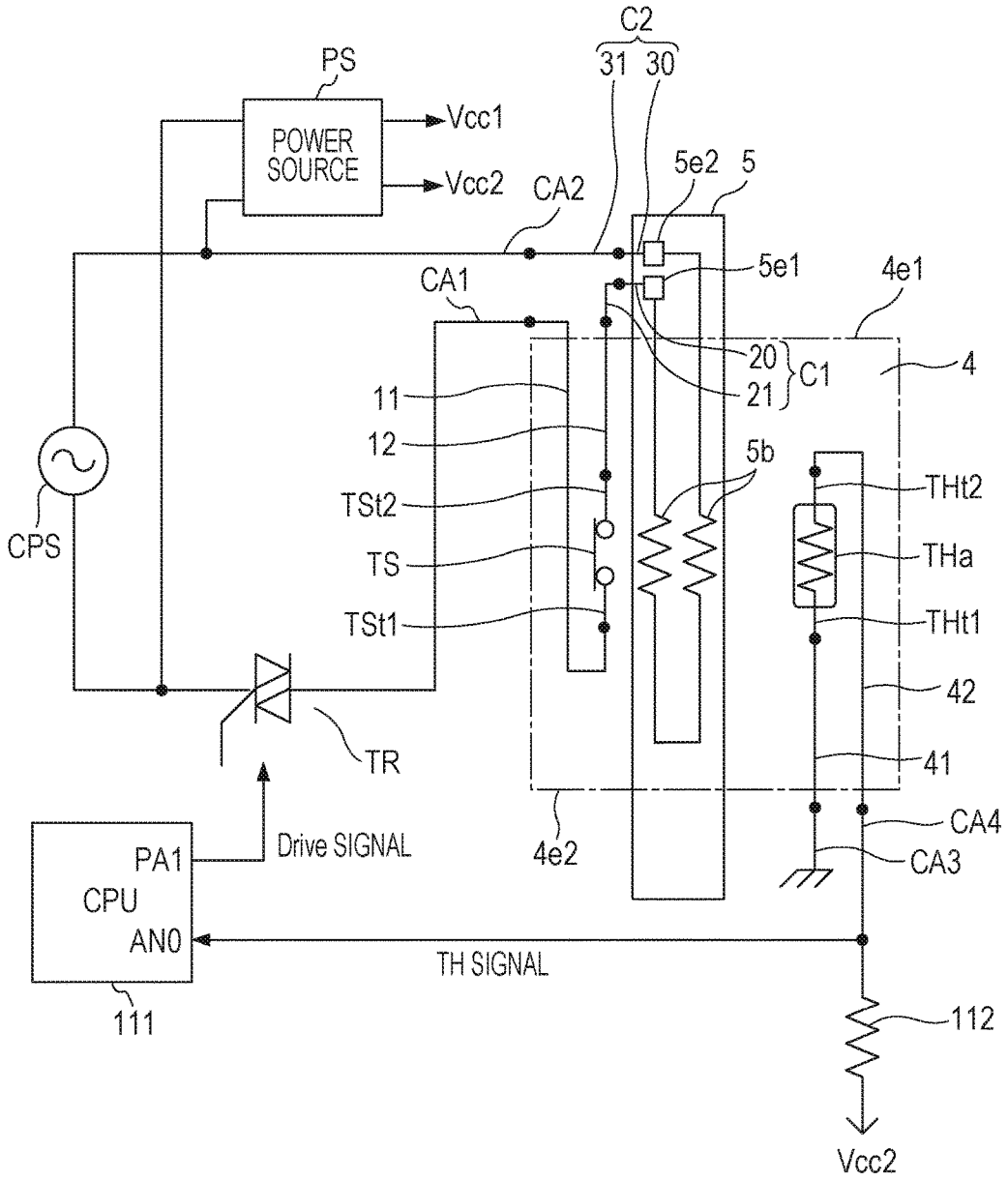
FIG. 4 is a diagram of a heater driving circuit according to the first embodiment.

FIG. 1A is a cross-sectional view of a fixing apparatus 1, FIG. 1B is a configuration diagram of a heater 5. FIGS. 2A and 2B are perspective views of the fixing apparatus 1. FIG. 3A is a cross-sectional view of a film unit 2, FIG. 3B is a configuration diagram of a thermistor unit, FIG. 3C is a configuration diagram of a thermal switch. FIG. 4 is a diagram of a heater driving circuit. FIG. 2B illustrates a state in which components 8, 9*a*, 9*b*, and SF are removed from the state shown in FIG. 2A. FIG. 3A is a cross-sectional view taken along line IIIA-IIIA in FIG. 1A. The basic configuration of the fixing apparatus 1 will be described with reference to the drawings.

The fixing apparatus 1 of this embodiment is a fixing apparatus using a film heating system. The fixing apparatus 1 includes a film unit 2 and a pressure roller 3. The film unit 2 includes a tubular film 4, a heater 5, a heater holder 6, a stay (a reinforcement) 7, a thermistor unit TH, and a thermal switch (a protection element) TS.

The film 4 is roughly fitted around the holder 6 and the stay 7. The film 4 includes a base layer and a surface layer (a release layer). The base layer is made of a resin material, such as polyimide and PEEK, or a metal material, such as stainless steel and nickel. The surface layer has high releasability and is made of a fluorocarbon polymer, for example.

The heater 5 is a ceramic heater in which a heat generating resistor 5*b* is disposed on a ceramic substrate 5*a*. Electrodes 5*e*1 and 5*e*2 are disposed to supply power to the heat generating resistor 5*b*. The heat generating resistor 5*b* is coated with an insulating layer 5*c*, such as glass. The heater 5 is long and narrow in a direction perpendicular to a recording-medium conveying direction D1.

The holder 6 is made of thermoplastic resin and holds the heater 5 along the length of the heater 5. The material of the holder 6 of this embodiment is a liquid crystal polymer (LCP). The holder 6 has a groove 6*a* that holds the heater 5 along the Y-axis direction.

The stay 7 is a reinforcement member in contact with the holder 6 in the longitudinal direction and is made of metal (in this embodiment, galvanized steel [iron]). The stay 7 provides sufficient rigidity to the film unit 2. As shown in FIG. 1A, the stay 7 is folded in a U-shaped in cross section. Restricting members 9*a* and 9*b* for restricting the film 4 from moving in the generatrix direction of the film 4 are disposed at both ends of the stay 7 in the longitudinal direction of the stay.

The pressure roller 3 is an elastic roller in which a rubber layer 3*b* is disposed around the circumference of a core metal 3*a* made of iron or aluminum. A gear 8 is attached to an end of the core metal 3*a*. The pressure roller 3 is rotated by applying power to the gear 8. The pressure roller 3 is rotatably held by frames SF of the fixing apparatus 1. The film unit 2 is attached to the frames SF from above the pressure roller 3. A load indicated by arrow BF is imposed on the restricting members 9*a* and 9*b*. The load BF is imposed on the restricting members 9*a* and 9*b*, the stay 7, the holder 6, the heater 5, the film 4, and the pressure roller 3 in this order to form a fixing nip portion N between the film 4 and the pressure roller 3. When motive power of a motor (not shown) is transmitted to the gear 8, the pressure roller 3 rotates in the direction of arrow D2, and the film 4 is rotated in the direction of arrow D2 with the rotation of the pressure roller 3. An unfixed image (a toner image) T is formed on a recording medium S by an image forming unit of a printer main body (not shown). The recording medium S bearing the unfixed image is conveyed while being nipped by the fixing nip portion N, during which the unfixed image is fixed to the recording medium S by the heat of the heater 5.

The thermistor unit TH that senses the temperature of the heater 5 is disposed in a space between the holder 6 and the stay 7 to receive the heat of the heater 5 through a through-hole 6*b*1 of the holder 6. The thermistor unit TH is disposed in the through-hole 6*b*1 of the holder 6 and is urged toward the heater 5 by a leaf spring SP1. This urging force brings the thermistor unit TH into contact with the heater 5. The thermistor unit TH is disposed in an area (an area Amin shown in FIG. 2B) through which a smallest standard-size recording medium that the image forming apparatus can use passes. An area Amax is an area through which a largest standard-size recording medium that the image forming apparatus can use passes.

As shown in FIG. 3B, the thermistor unit TH includes a base portion THb, an elastic portion THc held on the base portion THb, a thermistor (a temperature detecting element) THa held on the elastic portion THc, an insulating sheet THd disposed around the above components, and a hole THh with which the thermistor unit TH is attached to a pin 6*p* of the holder 6. The material of the base portion THb is liquid crystal polymer (LCP). The elastic portion THc is a stack of ceramic sheets having insulating properties. The material of the insulating sheet THd is polyimide. The thermistor THa electrically connects to two terminals THt1 and THt2. The thermistor THa is an element with resistance that decreases with an increasing temperature. A CPU 111 (described later) detects a change in voltage according to a change in resistance. The insulating sheet THd is in contact with the heater 5, and the thermistor THa detects the temperature of the heater 5 via the insulating sheet THd. The thermistor THa may be bonded to the heater 5.

The thermal switch TS serves as a protection element. The thermal switch TS is disposed on a power supply path to the heater 5 and has a role of interrupting power to the heater 5 by turning off the heater 5 when the heater 5 abnormally generates heat. The thermal switch TS is also disposed in the space between the holder 6 and the stay 7 in the film 4, as the thermistor unit TH is. The thermal switch TS is disposed in a through-hole 6*b*2 of the holder 6 and is brought into contact with the heater 5 by the urging force of a compressed spring SP2 disposed between the thermal switch TS and the stay 7. The thermal switch TS is also disposed in the area Amin as the thermistor unit TH is. Instead of the thermal switch TS, a thermal fuse may be used.

FIG. 3C is a cross-sectional view of the thermal switch TS. A switch TSa is accommodated in a resin case TSb. A thermosensitve portion TSc made of metal in contact with the heater 5 is disposed on part of the case TSb. The thermosensitve portion TSc accommodates a dome-shaped bimetal TSd. A rod TSf is disposed on the bimetal TSd and is to be pushed up by the bimetal TSd. The thermal switch TS further includes terminals TSt1 and TSt2. When the heater 5 abnormally rises in temperature, the shape of the bimetal TSd is reversed to raise the rod TSf, thereby turning off the switch TSa.

FIG. 4 is a wiring diagram of the fixing apparatus 1. An image forming apparatus equipped with the fixing apparatus 1 of this embodiment is supplied with power from a commercial power source (an AC power source) CPS. A power source PS outputs predetermined voltages Vcc1 (=24 V) and Vcc2 (=3.3 V) to loads, such as a motor and a control circuit, in the image forming apparatus.

The heater 5 is connected to the commercial power source CPS via a triac (a driving element) TR and the thermal switch TS and generates heat with AC power supplied from the commercial power source CPS.

The temperature of the heater 5 is monitored by the thermistor THa. One terminal THt1 of the thermistor THa is connected to the ground, and the other terminal THt2 is connected to a fixed resistor 112. The terminal THt2 is also connected to an input port AN0 of the CPU 111. The CPU 111 stores a temperature table (not shown) and detects the temperature of the heater 5 on the basis of a TH signal corresponding to a voltage in which the voltage Vcc2 is divided with the resistances of the thermistor THa and the fixed resistor 112.

The CPU 111 determines the duty ratio of the power to be supplied to the heater 5 so that the detected temperature (the TH signal) of the thermistor THa maintains a target control temperature. The CPU 111 outputs a Drive signal through an output port PA1 so that the triac (driving element) TR disposed on the power supply path to the heater 5 is driven at the determined duty ratio.

As shown in FIG. 4, the heater 5 is disposed in an AC circuit. AC cables CA1 and CA2 are strand wires coated with an insulator. The AC cable CA1 is connected to the terminal TSt1 of the thermal switch TS via a conductive component (a conductive member) 11. The terminal TSt2 of the thermal switch TS is connected to a conductive component (a conductive member) 12, and the conductive component 12 is connected to a conductive component 21. The conductive component 21 connects to a conductive component 20, and the conductive component 20 connects to the electrode 5*e*1 of the heater 5. The AC cable CA2 is connected to a conductive component 31. The conductive component 31 connects to a conductive component 30, and the conductive component 30 connects to the electrode 5*e*2 of the heater 5. As shown in FIG. 2B and FIG. 4, the wiring lines of the AC circuit jut out from an end 4*e*1 of the tubular film 4.

The thermistor THa is disposed in a DC circuit. A DC cable CA3, which is grounded at one end, is connected to the terminal THt1 of the thermistor TH via a conductive component 41. A DC cable CA4 is connected to the terminal THt2 of the thermistor TH via a conductive component 42. As shown in FIG. 2B and FIG. 4, the wiring lines of the DC circuit jut out from an end 4*e*2 of the tubular film 4.

The conductive components 11, 12, 41, and 42 are bare conductors uncoated with an insulator. As shown in FIG. 3A and FIG. 4, the thermistor unit TH and the thermal switch TS are disposed in a space between the holder 6 and the metal stay 7 in the film 4, and the conductive components 11, 12, 41, and 42 are also disposed in the same space. The conductive components 11, 12, 41, and 42 have to be separated from the stay 7 as much as possible so as to be isolated from the stay 7. For this purpose, this embodiment uses sheet metals having no insulating coating or jumper wires having no insulating coating as the conductive components 11, 12, 41, and 42 to ensure high rigidity and a long distance from the stay 7. Wiring lines constituting the AC circuit and wiring lines constituting the DC circuit will be described in detail hereinbelow.

[AC Circuit Configuration]

Figure 5A:
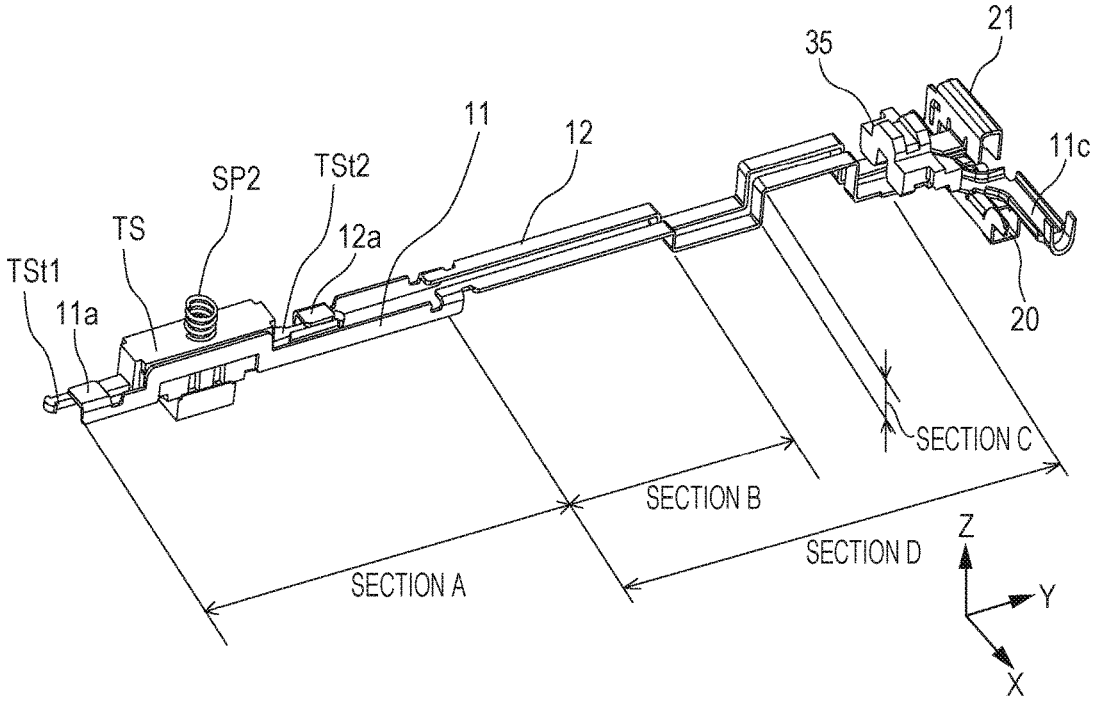
FIG. 5A is a perspective view of an AC circuit according to the first embodiment.

FIG. 5A is a perspective view of the AC circuit in the vicinity of the thermal switch TS. The conductive components 11 and 12 are made of sheet metal (aluminum with a thickness of 0.4 mm) formed by pressing. The thermal switch TS is disposed so that the terminal TSt1 and the terminal TSt2 are arranged side by side in the longitudinal direction of the heater 5. Conceivable configuration in which the sheet metal 11 connecting to the terminal TSt1 juts out from the tubular film 4 include a configuration in which the sheet metal 11 juts out from the end 4*e*2 of the film 4 and a configuration in which the sheet metal 11 is folded back at an intermediate point to jot out from the end 4*e*1. With the former configuration, it is difficult to satisfy an insulating distance between the AC circuit and the DC circuit because the AC circuit is disposed in the vicinity of the DC circuit in which the thermistor unit TH is disposed. For this reason, the sheet metal 11 may be folded back at an intermediate point to the outside of the tubular film 4 through the end 4*e*1, as in the latter configuration.

The shape of the sheet metal 11 may be designed to accommodate the spring SP2 that urges the thermal switch TS in the film 4. In this embodiment, the sheet metal 11 is folded 90 degrees from a portion (a joint 11*a* to the terminal TSt1) at which the thickness direction of the sheet metal 11 is parallel to a direction (a Z-axis direction) in which the thermal switch TS is urged to a direction in which the thickness direction of the sheet metal 11 is parallel to the X-axis (a section A [a first section]). The X-axis direction (a first direction) is the lateral direction of the heater 5. This shape allows the sheet metal 11 to be disposed on a side of the thermal switch TS to form a space-saving circuit. However, the section A of the sheet metal 11 has a large second area moment in the direction in which the thermal switch TS is urged, thus having high rigidity. Since the sheet metal 11 connects to the terminal TSt1 of the thermal switch TS at the joint 11*a*, the excessively high rigidity of the sheet metal 11 in the Z-axis direction will reduce the urging force of the spring SP2, causing the operation of the thermal switch TS to become unstable. To prevent it, the sheet metal 11 is again folded 90 degrees (a section B [a second section]) so that the thickness direction of the sheet metal 11 is parallel to the direction in which the thermal switch TS is urged (the Z-axis direction). The Z-axis direction (a second direction) is the thickness direction of the heater 5. The presence of the section B decreases the rigidity of the sheet metal 11 in the Z-axis direction, reducing the influence of the sheet metal 11 in the direction in which the thermal switch TS is urged, stabilizing the operation of the thermal switch TS.

The sheet metal 12 is connected to the conductive component 21 constituting a connector C1 (described later) attached to the heater holder 6. The sheet metal 12 (as well as the sheet metal 11) are thermally expanded because they are heated to high temperature by the heat from the heater 5. Since the sheet metal 12 is long in the longitudinal direction of the heater 5, the elongation due to thermal expansion is large. The end of the sheet metal 12 connected to the conductive component 21 cannot elongate because the position of the connector C1 is determined relative to the heater holder 6. A joint 12*a* of the sheet metal 12 connected to the thermal switch TS also cannot elongate because the position of the thermal switch TS is determined relative the heater holder 6. The sheet metal 12 is therefore elongated by thermal expansion, with both ends held, and is warped in the direction in which the thermal switch TS is urged (in the Z-axis direction). This reduces the urging force of the spring SP2, which can make the operation of the thermal switch TS unstable.

The warp of the sheet metal 12 is reduced so that the influence on the urging force of the spring SP2 can be reduced even if the sheet metal 12 is thermally expanded by providing the sheet metal 12 with a section C (a third section) in which the sheet metal 12 is folded so that the thickness direction of the sheet metal 12 is substantially parallel to the Y-axis direction (a third direction, or the longitudinal direction of the heater 5). The section C serves as a buffer area for reducing the warp of the sheet metal 12.

The sheet metal 11 also has the section C to prevent the sheet metal 11 from being warped due to thermal expansion. The sheet metal 12 also has the section B to reduce the rigidity of the sheet metal 12 in the Z-axis direction. The respective sections A of the sheet metal 11 and the sheet metal 12 are disposed at the same position in the Y-axis direction. The sections B of the sheet metal 11 and the sheet metal 12 are also disposed at the same direction in the Y-axis direction. The sections C of the sheet metal 11 and the sheet metal 12 are also disposed at the same position in the Y-axis direction. Disposing the sections A, B, and C of the sheet metals 11 and 12 at the same positions in the Y-axis direction reduces the space of the sheet metals 11 and 12.

Figure 5B:
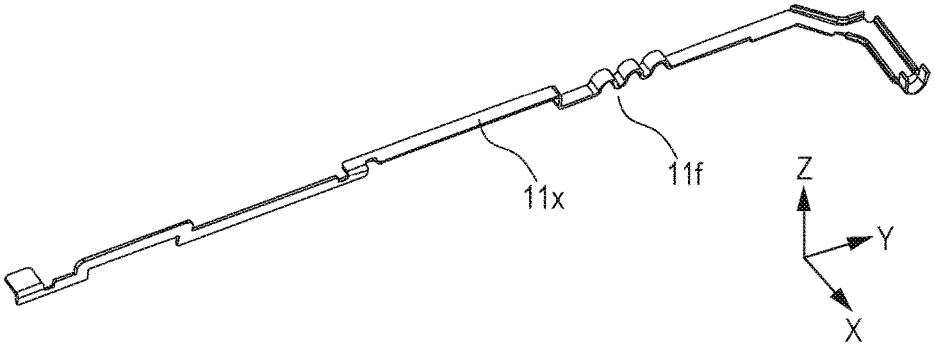
FIG. 5B is a perspective view of a conductive member of a modification.

As shown in FIG. 5B, the sheet metal 11 may have a corrugated portion so that the sheet metal 11 can expand and contract in the longitudinal direction of the heater 5, thereby reducing a reactive force applied to the thermal switch TS. A sheet metal 11*x*, which is a modification of the sheet metal 11, includes a corrugated portion 11*f*. This allows the reactive force applied to the thermal switch TS to be reduced by a decrease in the pitch of the corrugated portion 11*f* even if the sheet metal 11*x* thermally expands. Providing a plurality of (in FIG. 5B, three) waves in the corrugated portion 11*f* can further reduce the rigidity of the sheet metal 11*x* in the Y-axis direction, thereby reducing the height of the corrugated portion 11*f* in the Z-axis direction. This allows the sheet metal 11*x* to be reduced in size in the Z-axis direction. The sheet metal 12 may also have the corrugated portion.

Figure 6A:
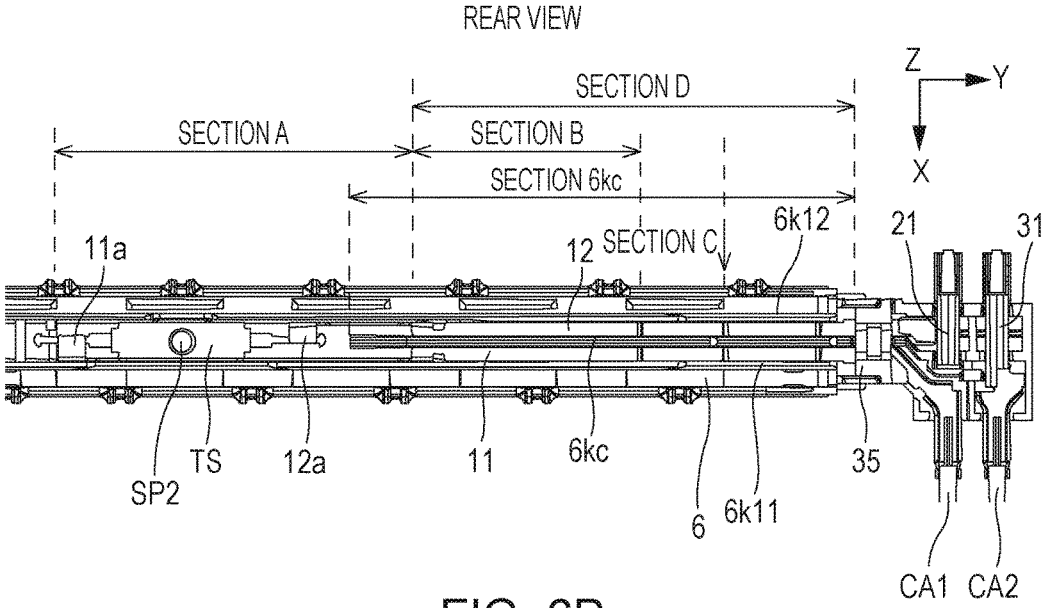
FIG. 6A is a diagram illustrating the positional relationship among a holder and sheet metals according to the first embodiment.
Figure 6B:
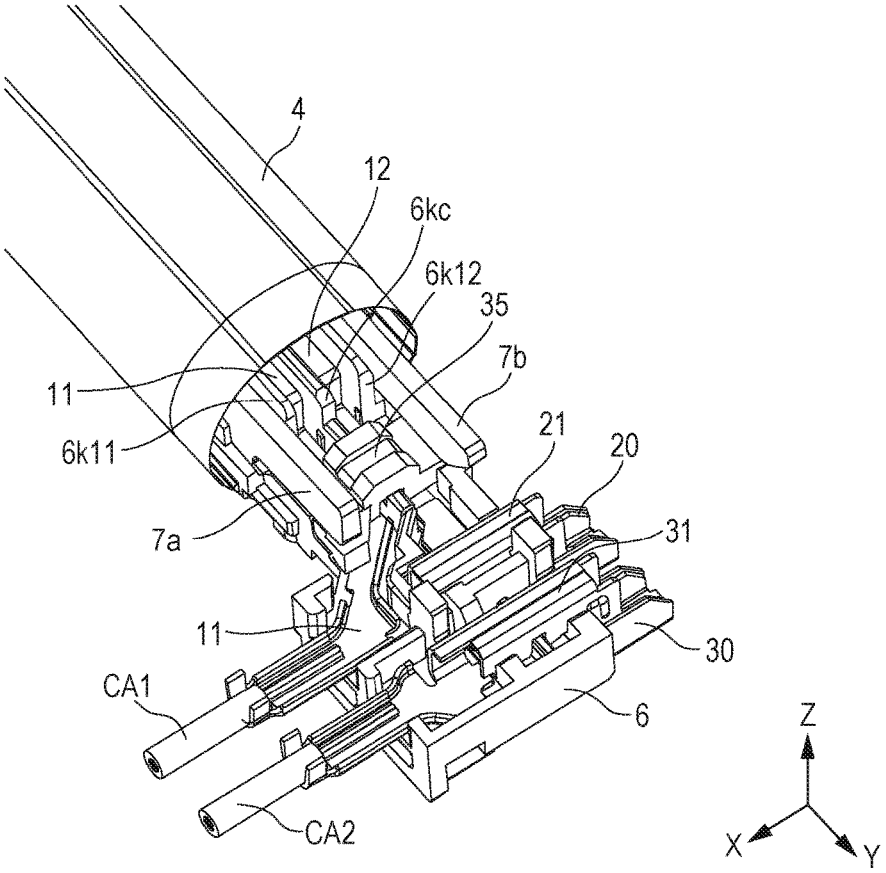
FIG. 6B is a perspective view of the holder and the sheet metals according to the first embodiment.

FIG. 6A is a diagram illustrating the positional relationship among the holder 6, the thermal switch TS, and the sheet metals 11 and 12 in the film 4. FIG. 6B is a perspective view of the sheet metals 11 and 12 and the holder 6 illustrating the positional relationship. The holder 6 has a wall portion 6*kc* for insulating the first sheet metal 11 and the second sheet metal 12 from each other. The distance between the first sheet metal 11 and the second sheet metal 12 is the smallest in a section D in which the thickness direction of the sheet metals 11 and 12 is the Z-axis direction. The wall portion 6*kc* is therefore disposed to include the section D in the Y-axis direction. Since the wall portion 6*kc* insulates the sheet metals 11 and 12 from each other, the sheet metals 11 and 12 are not short-circuited, stabilizing the operation of the thermal switch TS. The holder 6 further has a wall portion 6*k*11 that insulates the sheet metal 11 and the stay 7 from each other and a wall portion 6*k*12 that insulates the sheet metal 12 and the stay 7 from each other. The insulating distance between the sheet metal 11 and the metal stay 7 and the insulating distance between the sheet metal 12 and the metal stay 7 can be ensured by the form accuracy of the sheet metals 11 and 12. However, an external force from the cable CA1 could displace the sheet metal 11 in the Z-axis direction because the sheet metal 11 is directly connected to the cable CA1 at a cable connecting portion 11*c*. In other words, the sheet metal 11 could rise from the holder 6 in the Z-axis direction. If the sheet metal 11 rises from the holder 6 in the Z-axis direction, the sheet metal 11 can come into contact with the leg 7*a*, which is one of the legs 7*a* and 7*b* of the stay 7, which are pressed by the restricting member 9*a*. Therefore, an insulating spacer 35 is disposed between the sheet metal 11 and the stay 7 to ensure a sufficient insulating distance between the leg 7*a* and the sheet metal 11.

Figure 7A:
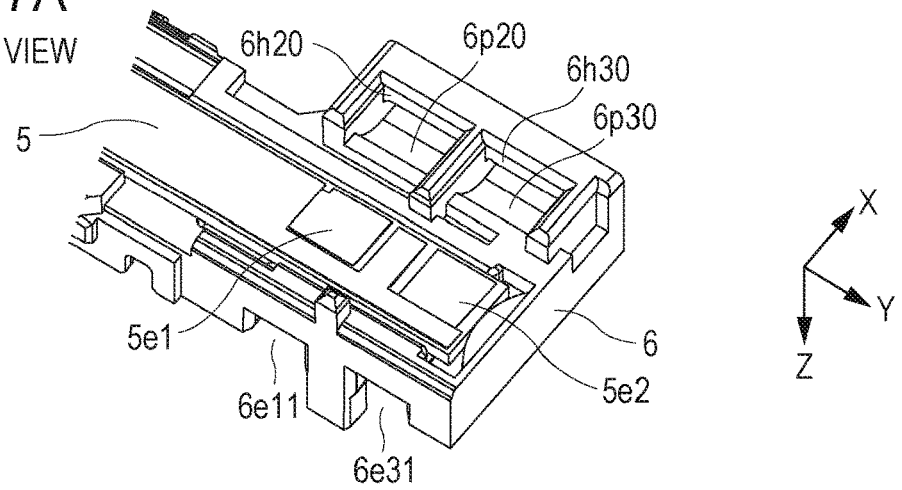
FIG. 7A is a perspective view of a heater attached to the holder viewed from the front.
Figure 7B:
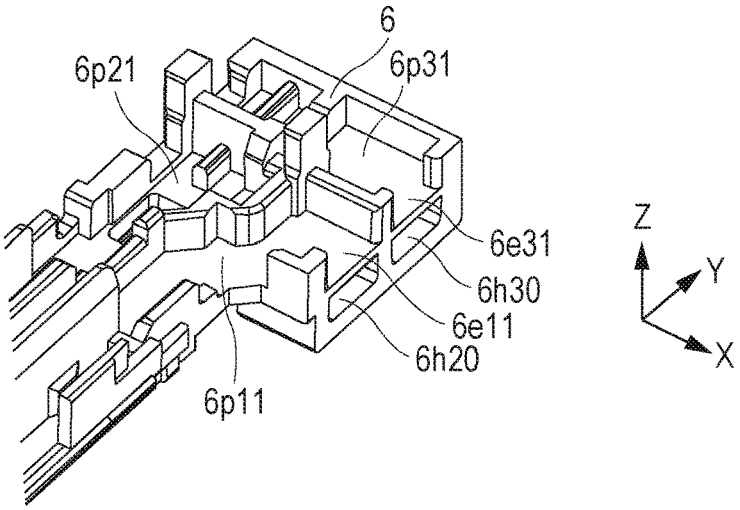
FIG. 7B is a perspective view of the heater attached to the holder viewed from the rear.
Figure 7C:
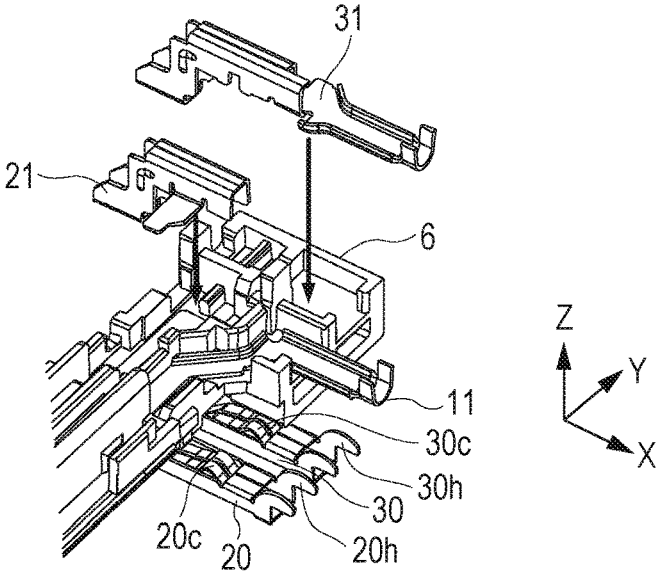
FIG. 7C is an exploded view of connectors relative to the holder to which the heater is attached viewed from the rear.

Referring next to FIGS. 7A to 7C to FIGS. 9A to 9C, the vicinity of a connection between the heater 5 and the connector C1 (a first power feeding connecter) and the connector C2 (a second power feeding connecter) will be described. FIGS. 7A and 7B are perspective views of the heater 5 attached to the holder 6 illustrating a state before the connectors C1 and C2 are attached to the holder 6. FIG. 7C is an exploded view of the connector C1 (20 and 21) and the connector C2 (30 and 31) relative to the holder 6 to which the heater 5 is attached.

FIG. 7A is a perspective view of the holder 6 viewed from a surface that holds the heater 5 (referred to as a front surface). FRONT VIEW in FIG. 7A corresponds to FRONT VIEW in FIG. 2B. The front surface of the holder 6 includes an attaching portion 6*p*20 to which the conductive component 20 (a first conductive component) constituting the connector C1 is attached and an attaching portion 6*p*30 to which the conductive component 30 (a first conductive component) constituting the connector C2 is attached. FIG. 7B is a perspective view of the holder 6 viewed from a surface opposite to the front surface (referred to as a rear surface). REAR VIEW in FIG. 7B corresponds to REAR VIEW in FIG. 2B. The rear surface of the holder 6 includes an attaching portion 6*p*21 to which the conductive component 21 (a second conductive component) constituting the connector C1 is attached and an attaching portion 6*p*31 to which the conductive component 31 (a second conductive component) constituting the connector C2 is attached. The holder 6 has a recessed portion 6*e*11 from which the sheet metal 11 protrudes and a recessed portion 6*e*31 from which the second conductive component 31 of the connector C2 protrudes at an end in the X-axis direction. The holder 6 further has a hole 6*h*20 in which a hook 20*h* of the first conductive component 20 of the connector C1 is to be fitted and a hole 6*h*30 in which a hook 30*h* of the first conductive component 30 of the connector C2 is to be fitted. The holder 6 further has an attaching portion 6*p*11 to which the sheet metal 11 is to be attached. As shown in FIG. 7C, the two conductive components 20 and 21 constituting the connector C1 are attached to the holder 6 in such a manner as to sandwich the holder 6 from the direction of the Z-axis. Likewise, the two conductive components 30 and 31 constituting the connector C2 are attached to the holder 6 in such a manner as to sandwich the holder 6 from the direction of the Z-axis. Specifically, the conductive components 21 and 31 are attached to the holder 6 from a direction opposite to the Z-direction. Next, the hook 20*h* of the conductive component 20 is inserted into the hole 6*h*20 of the holder 6, and the component 20 is rotated about the hook 20*h* so as to come close to the component 21. Likewise, the hook 30*h* of the conductive component 30 is inserted into the hole 6*h*30 of the holder 6, and the component 30 is rotated about the hook 30*h* so as to come close to the component 31.

Figure 8A:
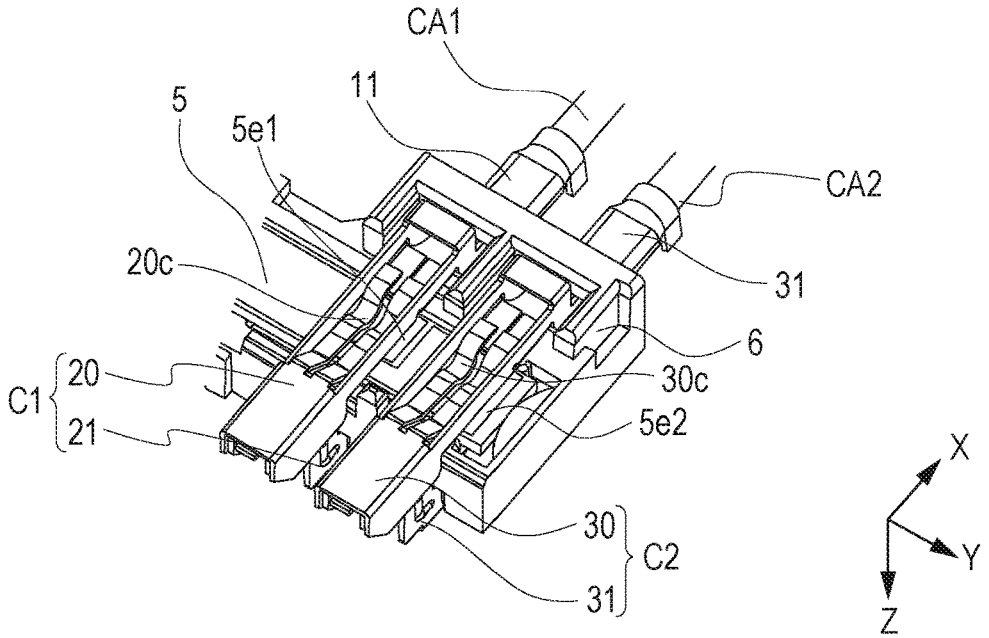
FIG. 8A is a perspective view of the connectors attached to the holder viewed from the front.
Figure 8B:
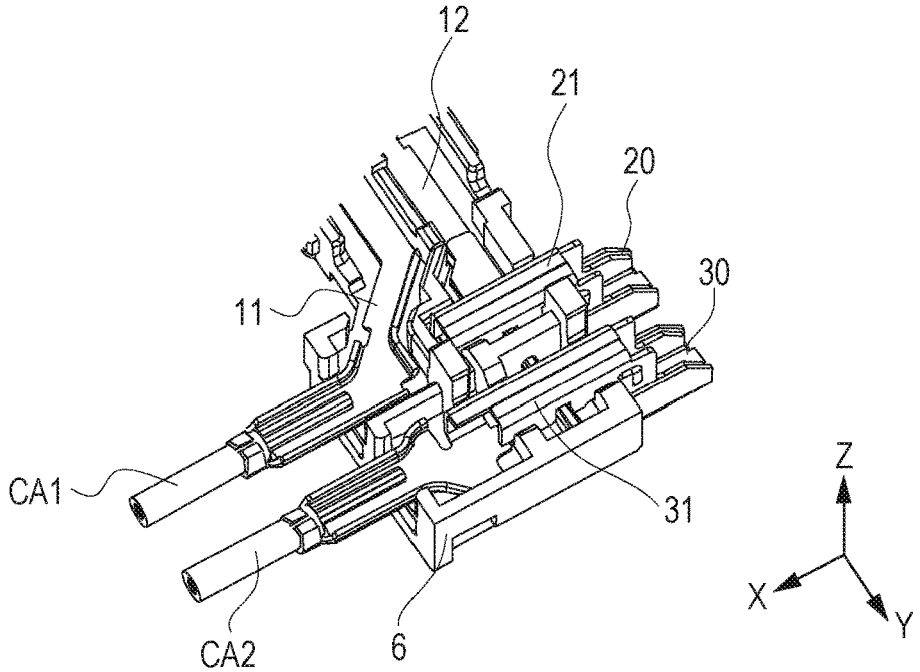
FIG. 8B is a perspective view of the connectors attached to the holder viewed from the rear.

FIGS. 8A and 8B illustrate a state in which the connectors C1 and C2 are attached to the holder 6. In this state, the first conductive component (a contact-side connector) 20 and the second conductive component (a backup-side connector) 21 of the connector C1 (the first power feeding connecter) are welded into one piece. The first conductive component (a contact-side connector) 30 and the second conductive component (a backup-side connector) 31 of the connector C2 (the second power feeding connecter) are also welded into one piece. The respective first conductive components 20 and 30 and the respective second conductive components 21 and 31 of the connectors C1 and C2 are joined (welded) at positions opposite to the positions at which the AC cables CA1 and CA2 are connected in the lateral direction of the heater 5. The first conductive component 20 of the connector C1 and the first conductive component 30 of the connector C2 respectively include spring contacts 20*c* and 30*c* in contact with the electrodes 5*e*1 and 5*e*2 of the heater 5. The spring contact 20*c* is in contact with the electrode 5*e*1, and the spring contact 30*c* is in contact with the electrode 5*e*2 in a state in which the connectors C1 and C2 are welded. Since the hook 20*h* of the conductive component 20 and the hook 30*h* of the conductive component 30 are respectively fitted in the holes 6*h*20 and 6*h*30 of the holder 6, as described above, loads on the welded portions can be reduced.

A configuration in which connectors are slid in the X-axis direction to be attached to the holder (and the heater) needs to prevent the connectors from coming off with snap-fits and needs a margin for deflection of the snap-fits. This needs looseness of the connectors relative to the heater in the lateral direction of the heater (in the X-axis direction), and needs to increase the size of the electrodes of the heater. In this embodiment, since two conductive members are attached to the holder 6 with the holder 6 therebetween, the electrodes of the heater 5 can be smaller than conventional ones. This further reduces the size of the heater 5.

Figure 9A:
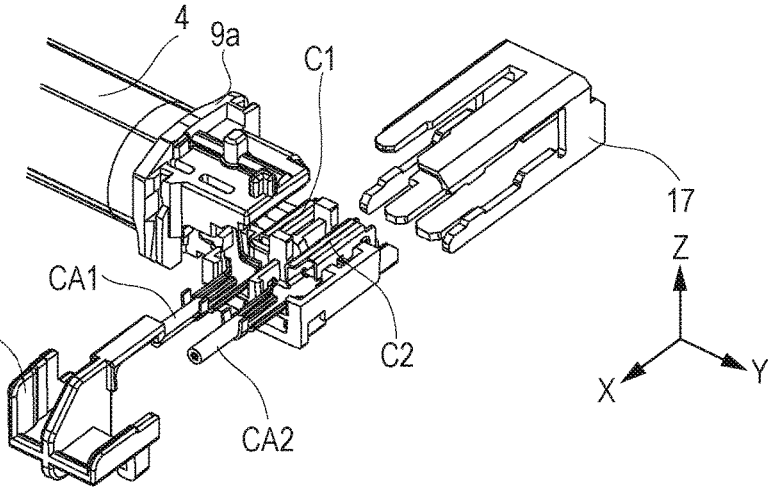
FIG. 9A is a perspective view of the holder illustrating a state in which an insulating cover is being attached.
Figure 9B:
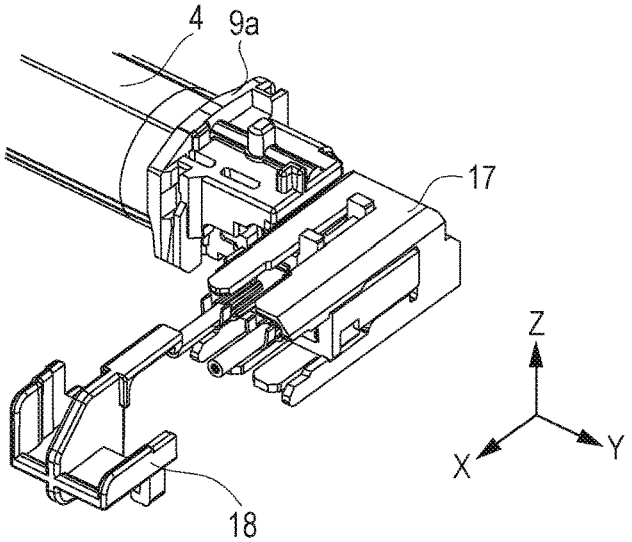
FIG. 9B is a perspective view of the holder illustrating a state in which the insulating cover is being attached.
Figure 9C:
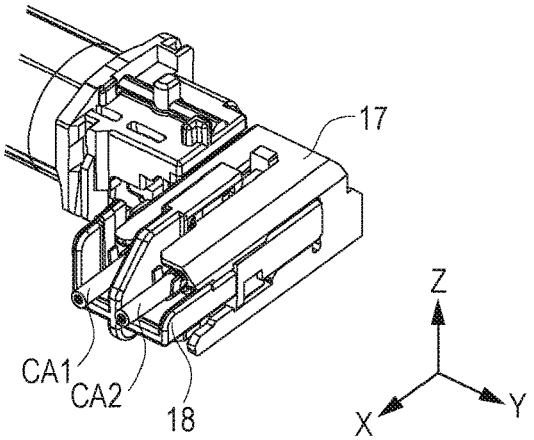
FIG. 9C is a perspective view of the holder illustrating a state in which the insulating cover is attached.

FIGS. 9A to 9C are perspective views of the holder 6 to which the connectors C1 and C2 are attached illustrating a state in which an insulating cover for covering the connectors C1 and C2 is being attached. The insulating cover is a combination of first and second insulating components 17 and 18. As shown in FIG. 9B, the first cover 17 is attached to the holder 6 from the X-axis direction, and then the second cover 18 is attached from a direction opposite to the direction in which the first cover 17 is attached. Thus, the conductive connectors C1 and C2 are attached to the holder 6, and then the connectors C1 and C2 are covered with the insulating cover.

[DC Circuit Configuration]

Figure 10:
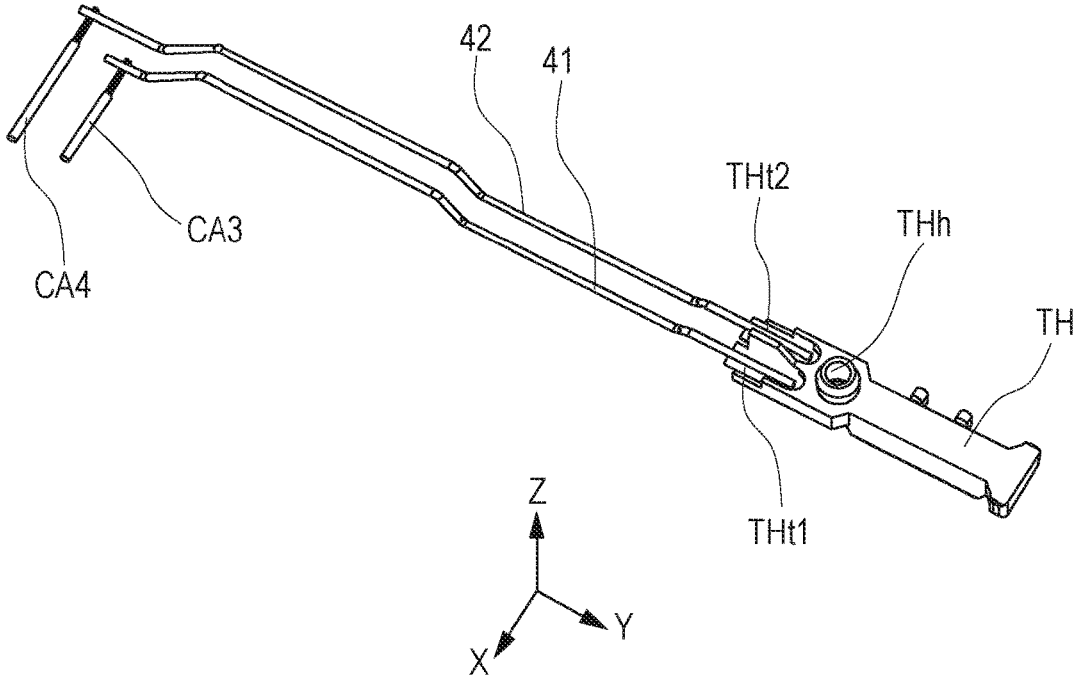
FIG. 10 is a perspective view of a DC circuit.

Next, the configuration of the DC circuit will be described with reference to FIG. 10. The thermistor unit (a temperature detecting unit) TH includes the terminals THt1 and THt2 at an end of the heater 5 in the longitudinal direction. Jumper wires are respectively used as wire rods (conductive members) 41 and 42 connected to the terminals THt1 and THt2. The wire rods 41 and 42 are bare wire rods having no insulating coating, which are in this embodiment lead-free solder plating annealed copper wires with a diameter of 0.6 mm. A first end of the wire rod 41 is welded to the terminal THt1, and a second end is soldered to a cable (a wire bundle) CA3. A first end of the wire rod 42 is welded to the terminal THt2, and a second end is soldered to a cable (a wire bundle) CA4. A current flowing through the DC circuit is far smaller than that across the AC circuit that feeds power to the heater 5, so that the wire rods 41 and 42 may have small cross-sectional areas. This allows thermal expansion of the wire rods 41 and 42, if occurs, to be absorbed by the deflection of the wire rods 41 and 42, having little influence on the urging force of the spring SP1 that urges the thermistor unit TH. For this reason, sheet metals as in the AC circuit may be used instead of the jumper wires.

The wire rod 41 and a conductor portion (a conductor) of the cable CA3 are connected in such a manner that the axes intersect (in this embodiment, substantially at right angles). This also applies to the wire rod 42 and the cable CA4. If a wire rod and a cable are connected in a straight line, the area of intersection of the wire rod and the cable in the lateral direction of the heater 5 (in the X-axis direction) is small, and the area of junction varies due to variations in the positional accuracy of the wire rod and the cable. This makes the joining strength unstable. In contrast, if the wire rod and the conductor portion of the cable are connected substantially at right angles, the area of intersection can be fixed both in the lateral direction and the longitudinal direction of the heater 5 (in the Y-axis direction). This allows the wire rode and the cable to be joined together at a fixed joining strength even if the individual positional accuracy of the wire rod and the cable varies. While this embodiment uses soldering to join the wire rod and the cable, any other electrical joining method, such as welding, may be used.

Figure 11A:
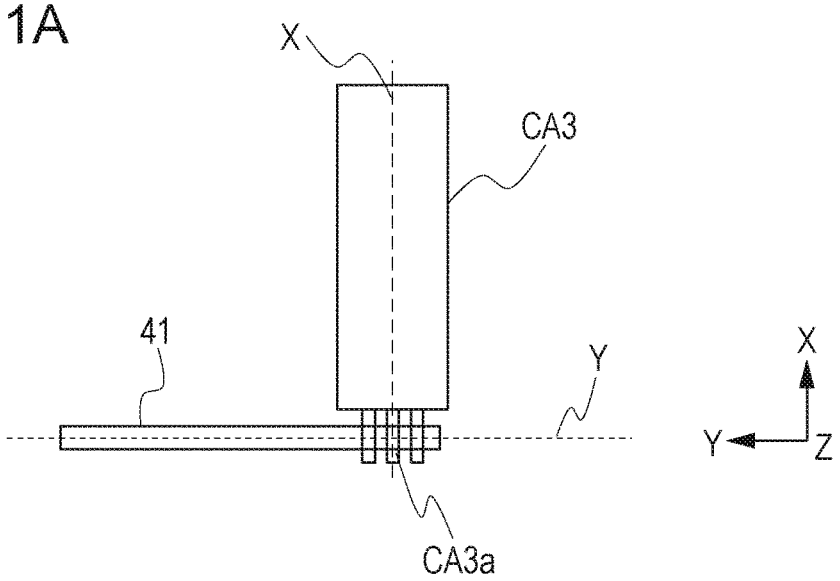
FIG. 11A is a diagram illustrating the connecting relationship between a cable and a wire rod according to the first embodiment of the present invention.
Figure 11B:
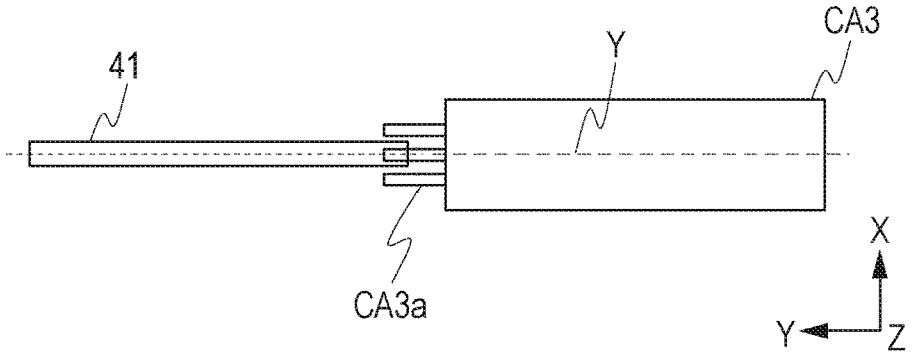
FIG. 11B is a diagram illustrating the connecting relationship between the cable and the wire rod in a comparative example.
Figure 11C:
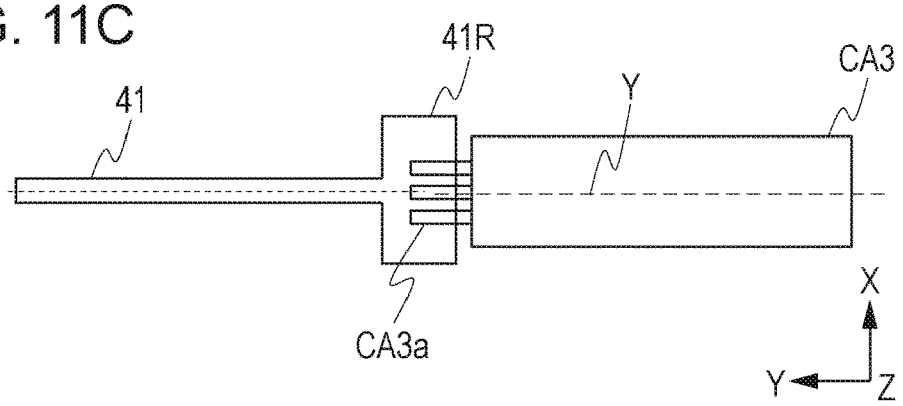
FIG. 11C is a diagram illustrating the connecting relationship between the cable and the wire rod in another comparative example.

FIG. 11A illustrates the connecting relationship between the cable CA3 and the wire rod 41 of this embodiment, and FIGS. 11B and 11C illustrate the connecting relationship between the cable CA3 and the wire rod 41 in a comparative example. As shown in FIG. 11A, the cable CA3 and the wire rod 41 of this embodiment are disposed at substantially right angles. The arrangement of the cable CA4 and the wire rod 42 is also the same, and a description thereof will be omitted. Conductor portions CA3*a* of the cable CA3 are bare conductors without insulating coating.

If the cable CA3 and the wire rod 41 are disposed substantially in parallel, as shown in FIG. 11B, the area of intersection of the conductor portions CA3*a* of the cable CA3 and the wire rod 41 in the X-axis direction is small. This causes the area of junction to be varied due to variations in the positional accuracy of the cable CA3 and the wire rod 41, making the joining strength unstable. If the area of a joining portion 41R of the wire rod 41 is increased, as shown in FIG. 11C, the area of junction can be increased even if variations in the positional accuracy of the wire rod 41 and the cable CA3 are large, but the fixing apparatus increases in size. In contrast, if the wire rod 41 and the cable CA3 are disposed substantially at right angles, as in this embodiment, the area of intersection can be fixed both in the X-axis direction and the Y-axis direction, allowing the wire rod 41 and the cable CA3 to be joined with stable joining strength. This provides a reliable fixing apparatus while reducing wiring cost using wire rods having no insulating coating.

Figure 12A:
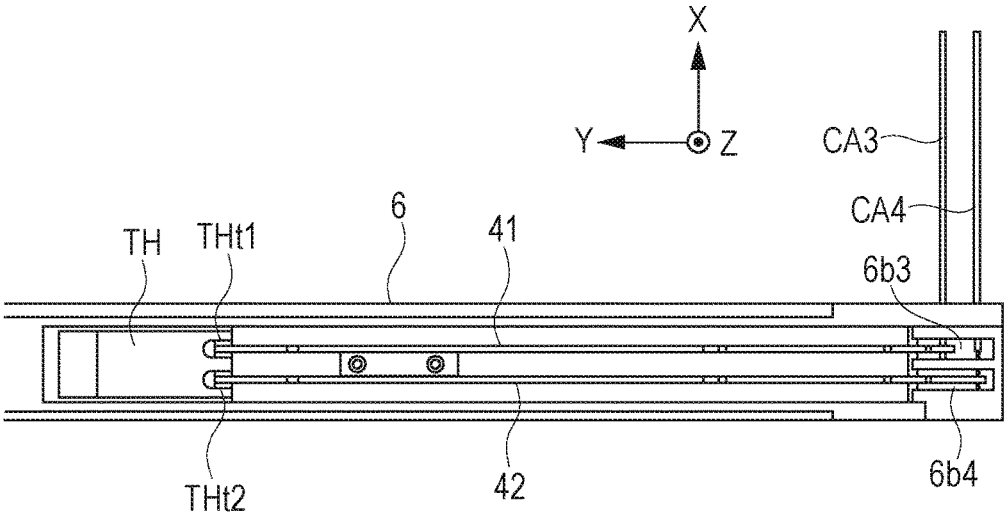
FIG. 12A is a diagram illustrating the configuration of the connection between wire rods and cables.
Figure 12B:
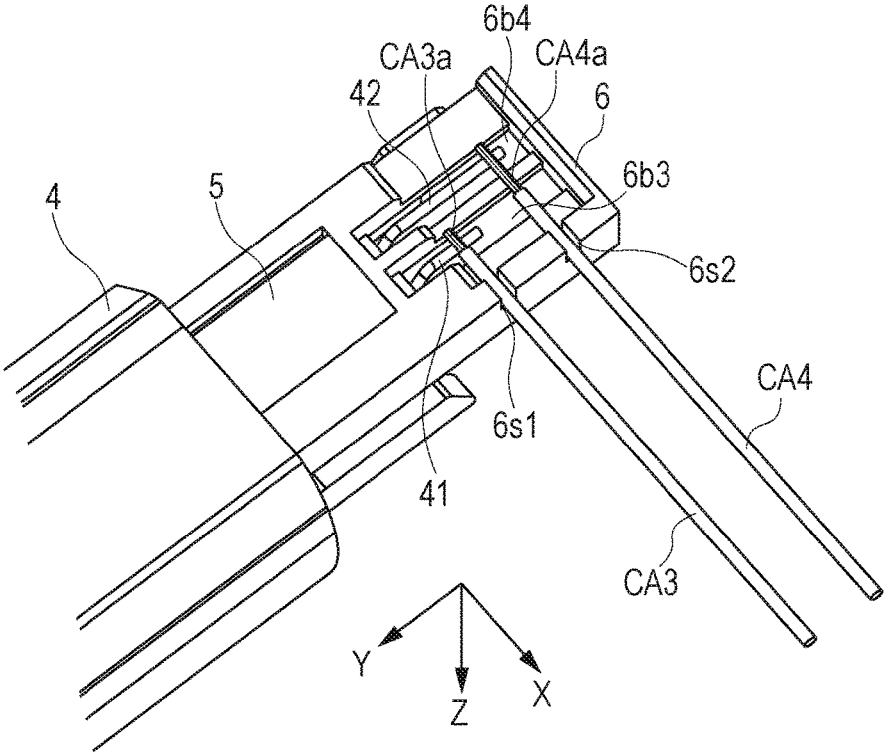
FIG. 12B is a diagram illustrating the configuration of the connection between wire rods and cables.

Referring next to FIG. 12A and FIG. 12B, the configuration of the vicinity of the connection between the wire rod 41 and the cable CA3 and the vicinity of the connection between the wire rod 42 and the cable CA4 will be described. As shown in FIG. 12A, the positions of connection between the second ends of the wire rods 41 and 42 and the conductor portions of the cables CA3 and CA4 correspond to an end of the holder 6 in the longitudinal direction of the heater 5 (in the Y-axis direction). As shown in FIG. 12A, the holder 6 has two holes 6*b*3 and 6*b*4 elongated in the Y-axis direction at an end of the holder 6 in the Y-axis direction. The second end of the wire rod 41 is located in the hole 6*b*3. The second end of the wire rod 42 is located in the hole 6*b*4. The wire rods 41 and 42 project from a surface opposite to a surface of the holder 6 that holds the heater 5 to the surface that holds the heater 5 through the holes 6*b*3 and 6*b*4. The second ends of the wire rods 41 and 42 and the conductor portions CA3*a* and CA4*a* of the respective cables CA3 and CA4 are connected on the surface of the holder 6 that holds the heater 5.

As shown in FIG. 12B, the surface of the holder 6 that holds the heater 5 has slits (restricting portions) 6*s*1 and 6*s*2 that respectively restrict the positions of the two cables CA3 and CA4 in the Y-axis direction. The slits 6*s*1 and 6*s*2 are disposed outside an area of the holder 6 at which the heater 5 is held in the longitudinal direction of the heater 5. The conductor portion CA3*a* of the cable CA3 fit in the slit 6*s*1 is soldered to the wire rod 41. The conductor portion CA4*a* of the cable CA4 fit in the slit 6*s*2 is soldered to the wire rod 42.

Even if an external force is exerted on the cables CA3 and CA4, the influence of the external force applied to the joints between the wire rods 41 and 42 and the cables CA3 and CA4 can be reduced because the positions of the cables CA3 and CA4 are restricted by the slits 6*s*1 and 6*s*2. Since the slits 6*s*1 and 6*s*2 are disposed outside the area of the holder 6 at which the heater 5 is held in the longitudinal direction of the heater 5, that is, the joints between the wire rods 41 and 42 and the cables CA3 and CA4 are outside the heater 5 in the Y-axis direction, the influence of the heat of the heater 5 on the cables CA3 and CA4 is reduced. This enables low-price cables with low heat resistance to be used. As is apparent from FIG. 2B, the positions of the slits 6*s*1 and 6*s*2 are outside the end face 4*e*2 of the film 4 in the Y-axis direction. The positions of the slits 6*s*1 and 6*s*2 in the Y-axis direction differ from each other. Thus, the position of joining between the wire rod 41 and the cable CA3 in the Y-axis direction and the position of joining between the wire rod 42 and the cable CA4 differ from each other. The difference between the positions of joints prevents the two wire rods 41 and 42 and the two cables CA3 and 2A4 from being combined by mistake.

While the wire rods 41 and 42 and the cables CA3 and 2A4 are joined by plating, any other electrical joining method may be used. While the wire rods 41 and 42 and the cables CA3 and 2A4 are joined in such a manner that the axes of the wire rods 41 and 42 and the axes of the cables CA3 and 2A4 intersect at right angles, any other angle of intersection may be employed.

[Assembly of Film Unit 2]

Figure 13:
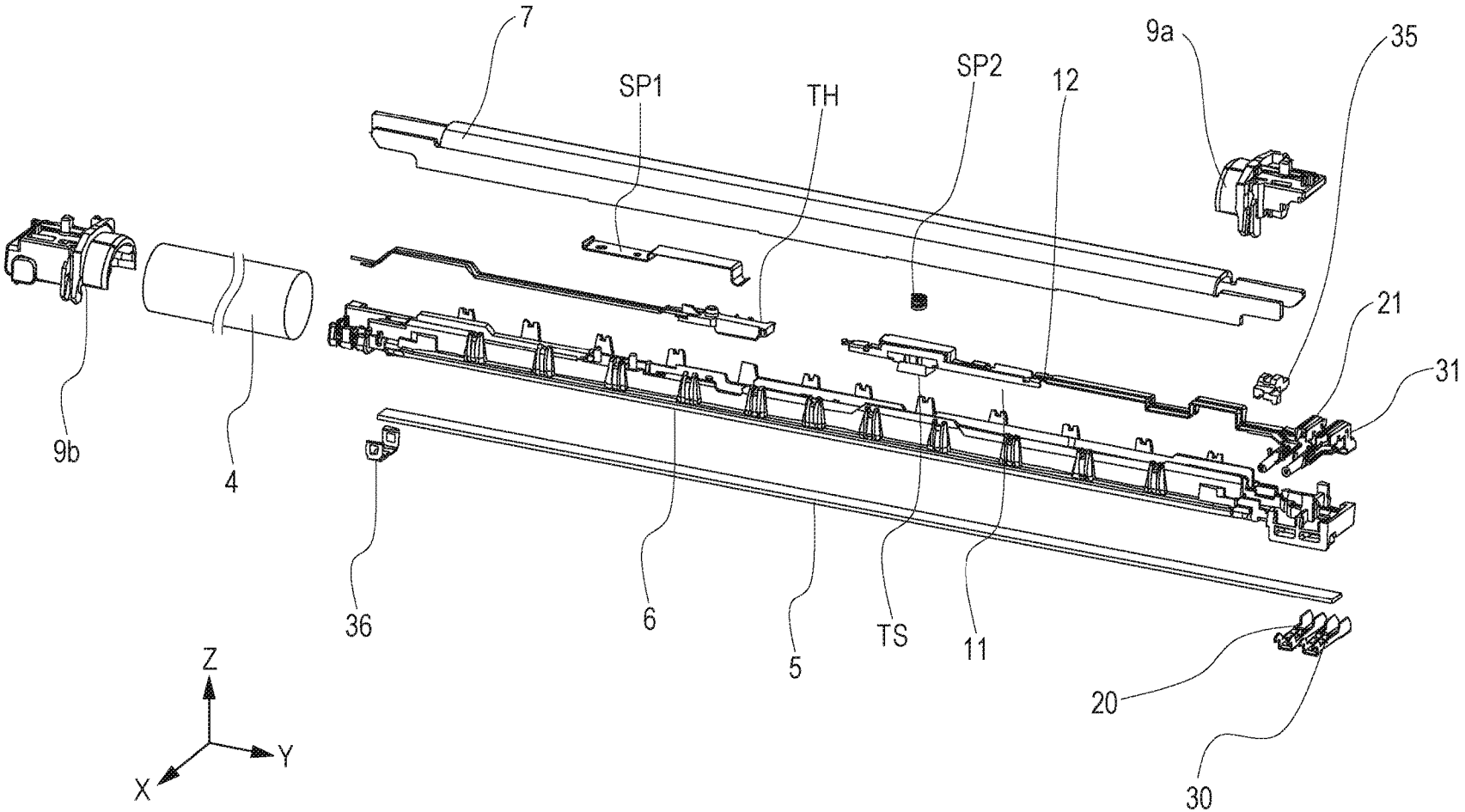
FIG. 13 is an exploded perspective view of a film unit.

FIG. 13 is an exploded perspective view of the film unit 2 illustrating the general arrangement. FIG. 13 illustrates a state before components are mounted to the holder 6. A heater retaining member 36 is used to retain the heater 5 to the holder 6. The thermistor unit TH, the wire rods 41 and 42, the thermal switch TS, the sheet metals 11 and 12, the backup-side connectors 21 and 31, the spacer 35, the stay 7, and the restricting member 9*a* are mounted to the holder 6 from a direction opposite to the Z-direction. The heater 5, the contact-side connectors 20 and 30, and the heater retaining member 36 are mounted to the holder 6 from the Z-direction. The film 4 and the restricting member 9*b* are mounted to the holder 6 from the Y-direction.

Thus, the components are mounted only from the two directions of the Y-axis direction and the Z-axis direction. This enables the fixing apparatus 1 to be assembled using a simple automatic assembly machine.

Next, another example of a reliable fixing apparatus manufactured at low wiring cost will be described.

[Second Embodiment]

A second embodiment will be described with reference to FIGS. 14A and 14B. A holder 6 of this embodiment includes four slits (restricting portions) 6*s*3, 6*s*4, 6*s*5, and 6*s*6. Although the connection between the wire rod 41 and the conductor portion CA3*a* of the cable CA3 and the connection between the wire rod 42 and the conductor portion CA4*a* of the cable CA4 are the same as the connections of the first embodiment, the direction of drawing the cables CA3 and CA4 differs from that in the first embodiment.

Figure 14A:
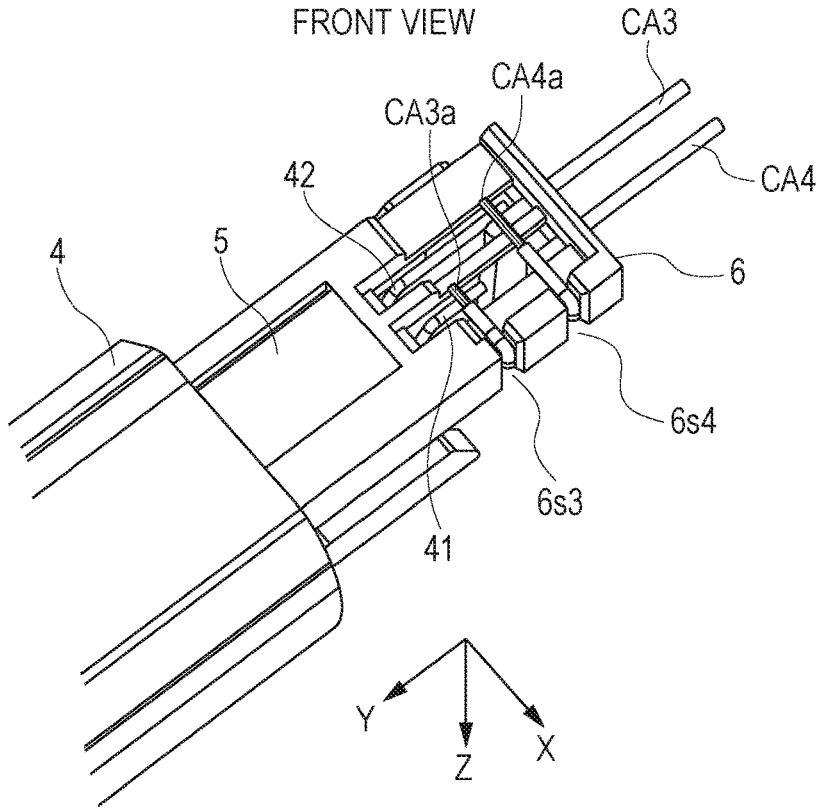
FIG. 14A is a diagram illustrating the connection between wire rods and cables according to a second embodiment of the present invention as viewed from the front.
Figure 14B:
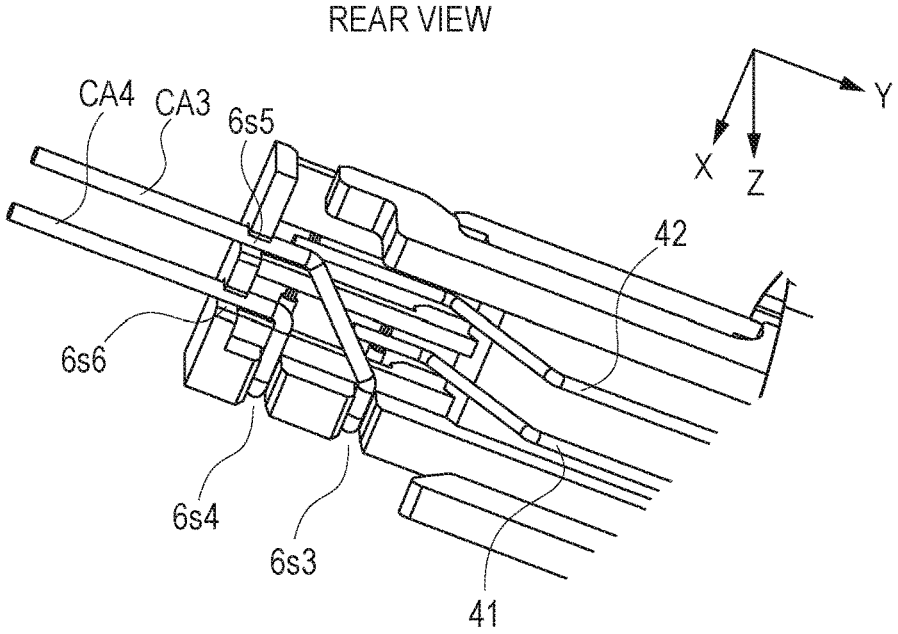
FIG. 14B is a diagram illustrating the connection between the wire rods and the cables according to the second embodiment of the present invention as viewed from the rear.

As shown in FIGS. 14A and 14B, the slits 6*s*3 and 6*s*4 (first restricting portions) have the role of routing the cables CA3 and CA4 over the rear surface of the holder 6 (a surface opposite to the surface that holds the heater 5) from the position of connection with the wire rods 41 and 42 while restricting the positions of the cables CA3 and CA4 in the longitudinal direction of the heater 5. The cables CA3 and CA4 routed over the rear surface of the holder 6 are respectively fitted in the slits (second restricting portions) 6*s*5 and 6*s*6 and are then drawn out in the Y-axis direction. Thus, the cables CA3 and CA4 are drawn out in the longitudinal direction of the heater 5, with the conductor portions of the cables CA3 and CA4 and the wire rods 41 and 42 intersecting each other. This configuration has an advantage of preventing the cables CA3 and CA4 from obstructing the insertion of the film 4 in the Y-axis direction during assembly of the fixing apparatus 1.

Next, an example of a fixing apparatus in which the friction between the spring contacts of connectors and the electrodes of a heater is reduced will be described.

[Third Embodiment]

Figure 15A:
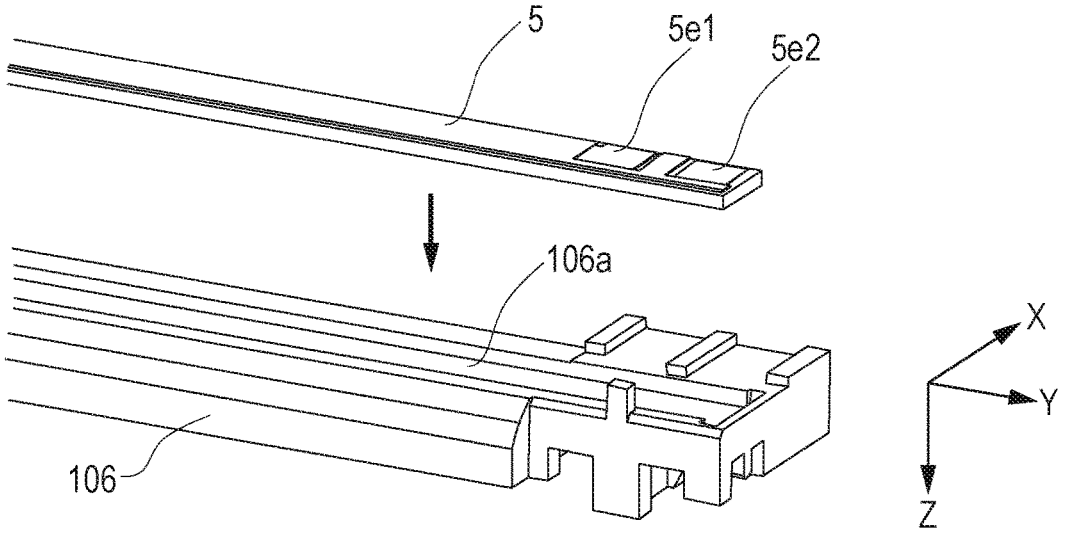
FIG. 15A is a perspective view of a connector of a fixing apparatus according to a third embodiment of the present invention.
Figure 15B:
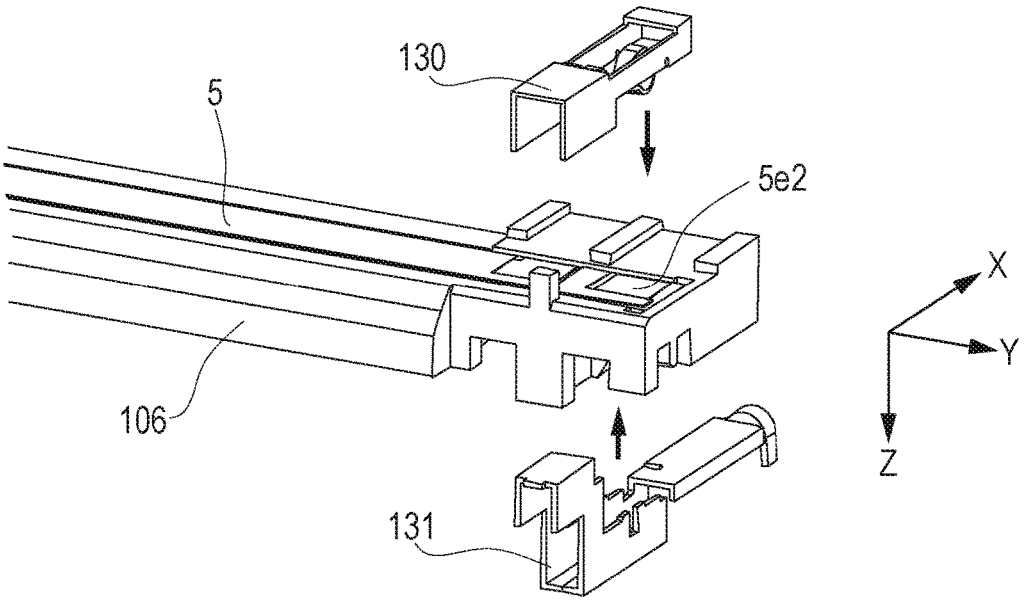
FIG. 15B is a perspective view of the connector according to the third embodiment.

A third embodiment will be described with reference to FIGS. 15A and 15B to FIGS. 18A to 18C. The same components as those in the first embodiment are given the same reference signs. FIG. 15A is a perspective view of a heater 5 and a heater holder 106 during mounting. The heater 5 is attached to a groove 106*a* in the heater holder 106. As shown in FIG. 15B, a first conductive component (a contact-side connector) 130 and a second conductive component (a backup-side connector) 131 of a connector (second connector) C2 are attached to the holder 106 to which the heater 5 is mounted. Difference from the first embodiment is that the first conductive component 130 has no hook. The connector C1 has substantially the same configuration as that of the connector C2 (that is, a first conductive component of the connector C1 also has no hook), and an illustration and a description of the connector C1 will be omitted.

Figure 16A:
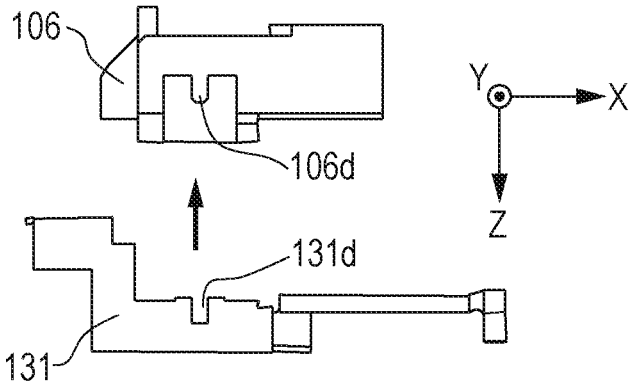
FIG. 16A is a side view of the connector and the holder according to the third embodiment (before mounting).
Figure 16B:
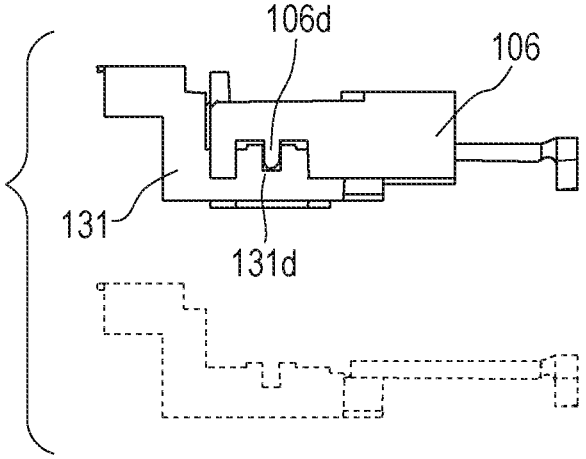
FIG. 16B is a side view of the connector and the holder (after mounting).
Figure 16C:
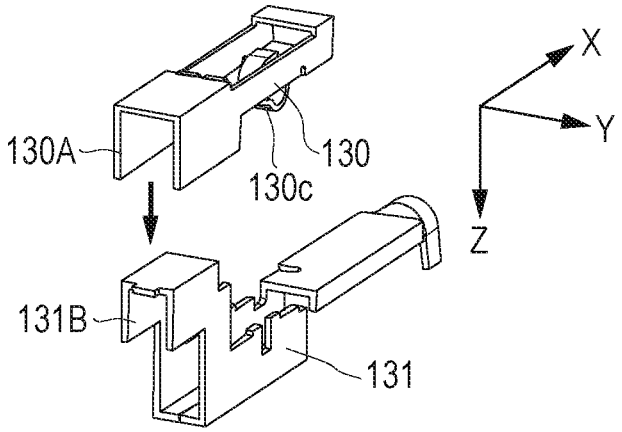
FIG. 16C is a perspective view of the connector (before mounting).
Figure 16D:
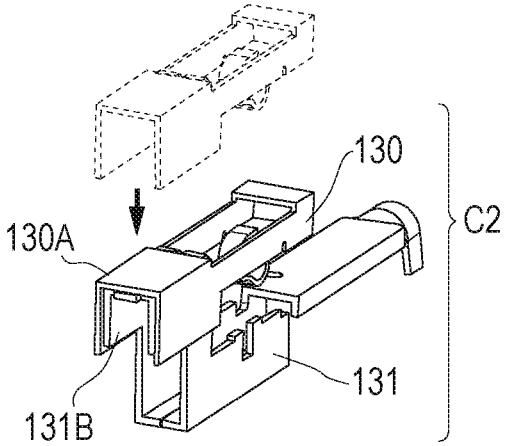
FIG. 16D is a perspective view of the connector (after mounting).

FIG. 16A is a side view of the second conductive component 131 and the holder 106 (before mounting), and FIG. 16B is a side view of the second conductive component 131 and the holder 106 (after mounting). FIG. 16C is a perspective view of the first conductive component 130 and the second conductive component 131 (before mounting), and FIG. 16D is a perspective view of the first conductive component 130 and the second conductive component 131 (after mounting). In FIGS. 16C and 16D, the holder 106 is omitted.

As shown in FIGS. 16A and 16B, a groove 131*d* in the second conductive component 131 and a protrusion 106*d* of the holder 106 engage with each other. As shown in FIGS. 16C and 16D, an end 130A of the first conductive member 130 and an end 131B of the second conductive member 131 engage with each other. Although this embodiment employs an engaging system using a protrusion and a groove, a system using a shaft and a hole may be employed.

Figure 17A:
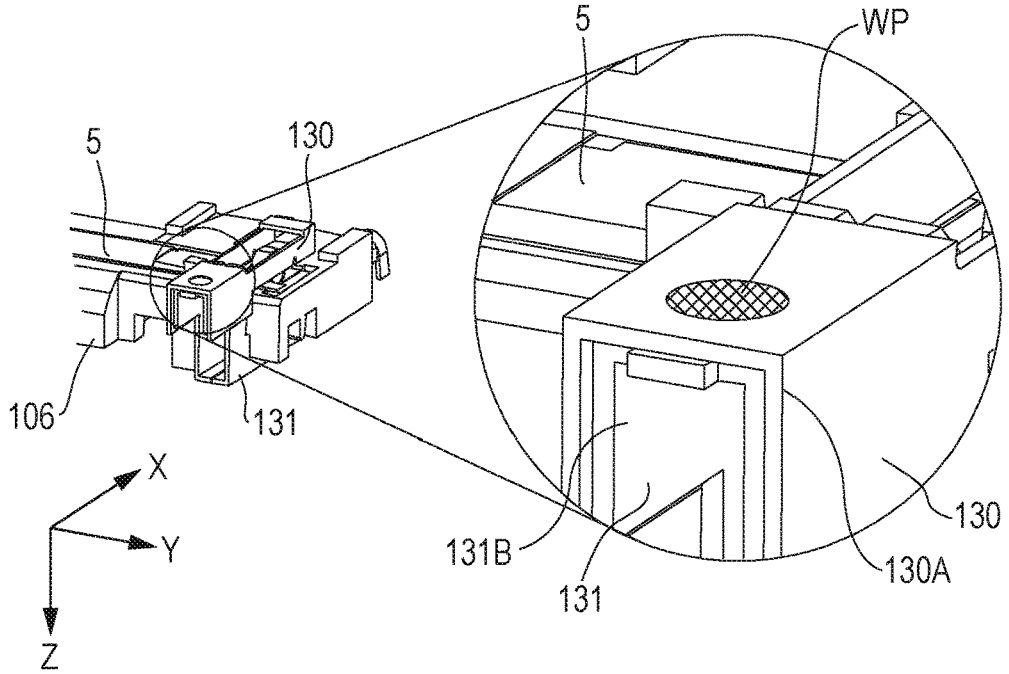
FIG. 17A is an enlarged view of the connector according to the third embodiment.
Figure 17B:
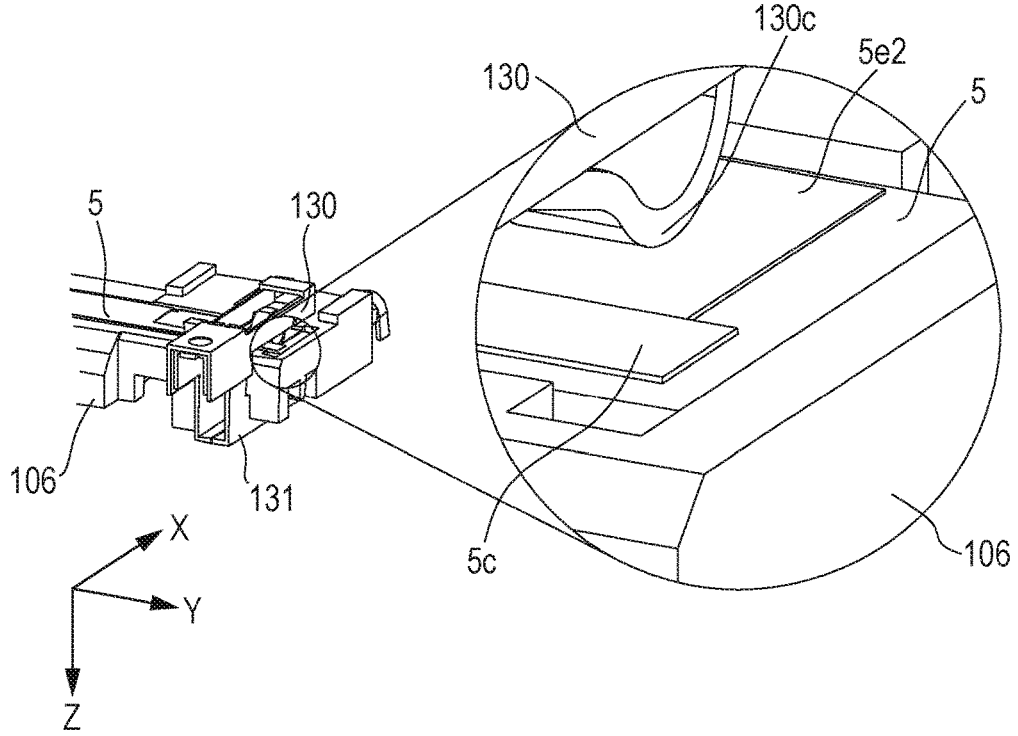
FIG. 17B is an enlarged view of the connector according to the third embodiment.

FIG. 17A is an enlarged view of the connection between the first conductive component 130 and the second conductive component 131, and FIG. 17B is an enlarged view of the connection between the first conductive component 130 and an electrode 5*e*2 of the heater 5. As shown in FIG. 17A, a portion WP where the end 130A of the first conductive component 130 and the end 131B of the second conductive component 131 overlap is welded to join the first conductive component 130 and the second conductive component 131 together. The welding portion is a surface perpendicular to the Z-axis direction. By joining the first conductive member 130 and the second conductive member 131, the connector C2 is held on the holder 106. In this state, a spring contact 130*c* of the first conductive component 130 is pressed onto the electrode 5*e*2 of the heater 5. The first conductive component 130 and the second conductive component 131 may not be joined by welding but may be joined using another method. For example, they may be joined using an adhesive, swaging, screwing, or snap-fitting.

Figure 18A:
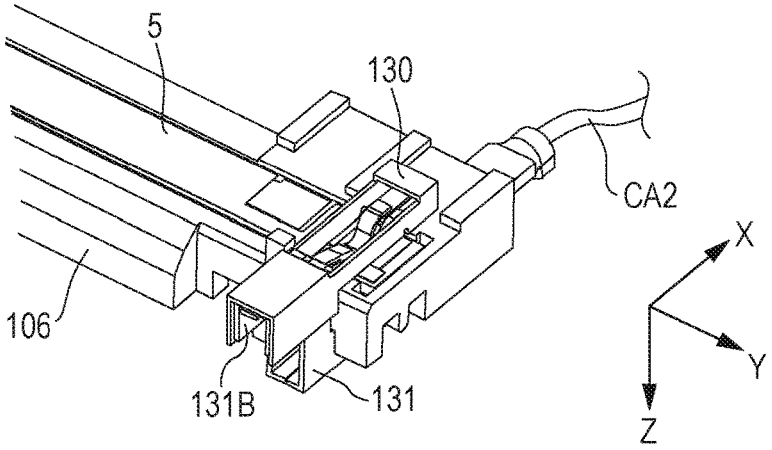
FIG. 18A is a perspective view of the connector according to the third embodiment.
Figure 18B:
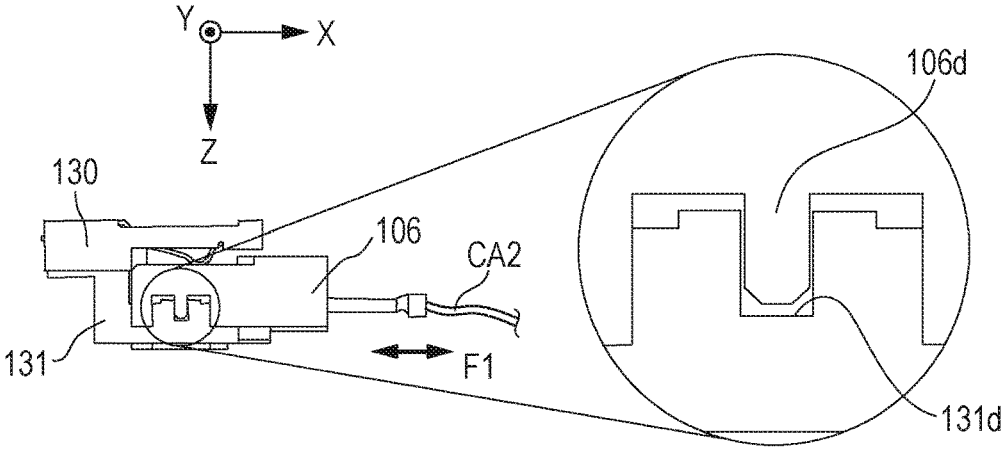
FIG. 18B is a side view of the connector under an external force F1.
Figure 18C:
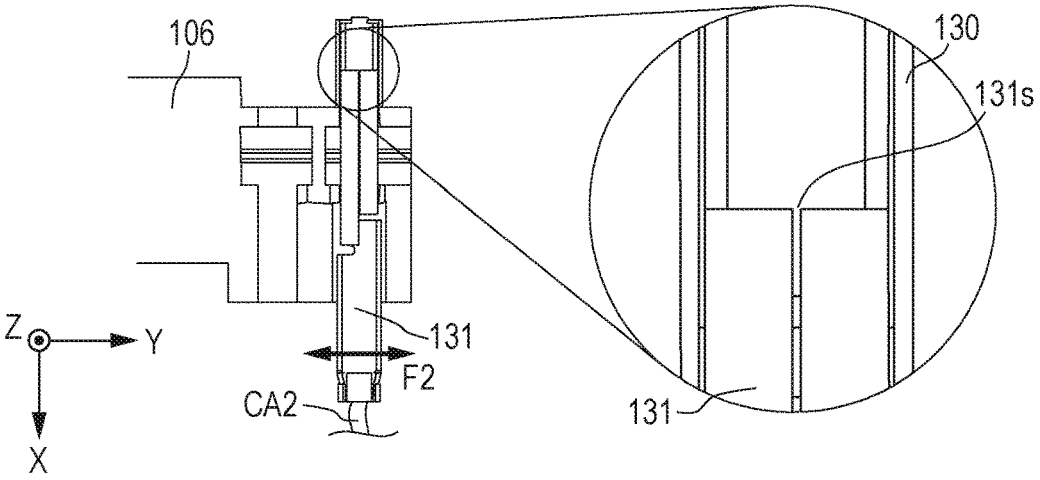
FIG. 18C is a bottom view of the connector under an external force F2.

FIG. 18A is a perspective view of the first conductive component 130 and the second conductive component 131 after a cable CA2 is attached to the second conductive member 131, FIG. 18B is a side view thereof, and FIG. 18C is a bottom view thereof. As shown in FIG. 18A, the cable CA2 is connected to an end of the second conductive member 131, that is, an end different from the end 131B to be welded.

Suppose that an external force F1 acts on the connection between the cable CA2 and the second conductive component 131. As shown in FIG. 18B, even if the external force F1 is exerted in the lateral direction of the holder 106 (in the X-direction), movement of the second conductive component 131 in the X-direction is prevented because the groove 131*d* of the second conductive component 131 and the protrusion 106*d* of the holder 106 engage. This reduces or eliminates the friction between the spring contact 130*c* of the first conductive component 130 joined to the second conductive component 131 and the electrode 5*e*2 of the heater 5. Furthermore, the second conductive component 131 has a slit 131*s* at the center, as shown in FIG. 18C. The slit 131*s* allows the second conductive component 131 to be elastically deformed between the portion WP joined to the first conductive component 130 and the connection to the cable CA2 if an external force F2 in the Y-axis direction is exerted. This elastic deformation absorbs the external force F2, so that the friction between the spring contact 130*c* of the first conductive component 130 and the electrode 5*e*2 of the heater 5 can be reduced or eliminated.

While in this embodiment the second conductive component 131 has the elastically deformed portion, the first conductive component 130 may have the elastically deformed portion between the portion WP joined to the second conductive component 131 and the contact to the electrode 5*e*2 of the heater 5.

Since the connector C2 divided into a contact-side connector and a backup-side connector is mounted to the heater holder 106 and then the connectors are joined together, as described above, the friction between the spring contact 130*c* and the heater electrode 5*e*2 when the connector C2 is mounted to the heater 5 can be prevented. Setting a direction in which the first conductive component 130 and the second conductive component 131 are mounted to the heater holder 106 and a direction in which the heater 5 is mounted to the heater holder 106 to substantially the same direction enables the film unit 2 to be assembled by an operation in only one direction, allowing the film unit 2 to be assembled using a simple automatic machine.

While in the first and third embodiments the backup-side connectors are respectively the conductive components 21 and 131, the backup-side connectors may be non-conductive components. In this case, the cable CA2 is connected to the first conductive component 20 or 130, which is a contact-side connector.

The first conductive component 130 and the second conductive component 131 may be made of different materials. The contact-side connector (the first conductive component) needs a spring characteristic necessary for maintaining the contact pressure to the electrode 5*e*2 of the heater 5 under a high-temperature environment and an electrical characteristic of small electrical resistance, requiring a high-price material. In the first and third embodiments, each connector is divided into the contact-side connector and the backup-side connector, as described above. For this reason, it is only required that only the contact-side connector in contact with the electrode of the heater 5 satisfies the spring characteristic and the electrical characteristic, and the second conductive component can be made of a low-price material.

If the backup-side connector has lower thermal conductivity than that of the contact-side connector, heat radiation from the end of the heater 5 in the longitudinal direction is prevented, reducing a varication in temperature of the heater 5 in the longitudinal direction.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A fixing apparatus comprising:

a tubular film;

a heater provided at an inside of the film, the heater including an electrode;

a holder provided at the inside of the film, the holder being configured to hold the heater; and a power feeding connector configured to feed power to the heater;

wherein an unfixed image formed on a recording medium is fixed on the recording medium by the heat of the heater via the film, wherein the power feeding connector comprises a contact-side connector and a backup-side connector, the contact-side connector including a spring contact in contact with the electrode of the heater, the backup-side connector being disposed on a side of a surface of the holder that holds the heater opposite to a side of a surface on which the contact-side connector is disposed, wherein the contact-side connector and the backup-side connector are joined together to form the power feeding connector, wherein the contact-side connector is a conductive component and the backup-side connector is a component made of material different from the contact-side connector, wherein the contact-side connector and the backup-side connector are joined together at a position opposite to a position at which the power feeding connector and a power feed cable are connected in a lateral direction of the heater, and wherein the backup-side connector includes an elastically deformed portion between the position of joining and the power feed cable in the lateral direction.

2. The fixing apparatus according to claim 1, wherein both of the contact-side connector and the backup-side connector are conductive components.

3. The fixing apparatus according to claim 2, wherein the contact-side connector and the backup-side connector are conductive components made of different materials.

4. The fixing apparatus according to claim 1, wherein the backup-side connector is made of a material with lower thermal conductivity than a thermal conductivity of a material of the contact-side connector.

5. The fixing apparatus according to claim 1, wherein the contact-side connector is a conductive component, and the backup-side connector is a nonconductive component.

6. The fixing apparatus according to claim 1, wherein the contact-side connector and the backup-side connector are joined by welding.

7. The fixing apparatus according to claim 1, wherein the elastically deformed portion includes a slit.

8. The fixing apparatus according to claim 1, further comprising a roller configured to form a fixing nip portion through which the recording medium is conveyed in cooperation with the heater via the film.

9. A fixing apparatus comprising:

a tubular film;

a heater provided at an inside of the film, the heater including an electrode;

a holder provided at the inside of the film, the holder being configured to hold the heater; and a power feeding connector configured to feed power to the heater, wherein an unfixed image formed on a recording medium is fixed on the recording medium by the heat of the heater via the film, wherein the power feeding connector comprises a contact-side connector and a backup-side connector, the contact-side connector including a spring contact in contact with the electrode of the heater, the backup-side connector being disposed on a side of a surface of the holder that holds the heater opposite to a side of a surface on which the contact-side connector is disposed, wherein the contact-side connector and the backup-side connector are joined together to form the power feeding connector, wherein the contact-side connector is a conductive component and the backup-side connector is a component made of material different from the contact-side connector, wherein the contact-side connector and the backup-side connector are joined together at a position opposite to a position at which the power feeding connector and a power feed cable are connected in a lateral direction of the heater, and wherein the contact-side connector includes an elastically deformed portion between the position of joining and the power feed cable in the lateral direction.

10. The fixing apparatus according to claim 9, wherein both of the contact-side connector and the backup-side connector are conductive components.

11. The fixing apparatus according to claim 10, wherein the contact-side connector and the backup-side connector are conductive components made of different materials.

12. The fixing apparatus according to claim 9, wherein the backup-side connector is made of a material with lower thermal conductivity than a thermal conductivity of a material of the contact-side connector.

13. The fixing apparatus according to claim 9, wherein the contact-side connector is a conductive component, and the backup-side connector is a nonconductive component.

14. The fixing apparatus according to claim 9, wherein the contact-side connector and the backup-side connector are joined by welding.

15. The fixing apparatus according to claim 9, wherein the elastically deformed portion includes a slit.

16. The fixing apparatus according to claim 9, further comprising a roller configured to form a fixing nip portion through which the recording medium is conveyed in cooperation with the heater via the film.

* * * * *